US007648219B2

(12) United States Patent
Sugahara

(10) Patent No.: US 7,648,219 B2
(45) Date of Patent: Jan. 19, 2010

(54) LIQUID-DROPLET JETTING APPARATUS HAVING A MOVABLE BODY FOR DETECTING AND PURGING ABNORMAL NOZZLES

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 219 days.

(21) Appl. No.: 11/533,747

(22) Filed: Sep. 20, 2006

(65) Prior Publication Data

US 2007/0064041 A1 Mar. 22, 2007

(30) Foreign Application Priority Data

Sep. 21, 2005 (JP) ..... 2005-273055

(51) Int. Cl.
*B41J 29/393* (2006.01)
*B41J 2/165* (2006.01)

(52) U.S. Cl. ..... 347/19; 347/29

(58) Field of Classification Search ..... 347/19, 347/32

See application file for complete search history.

(56) References Cited

U.S. PATENT DOCUMENTS 5,250,962 A 10/1993 Fisher et al.
5,367,326 A * 11/1994 Pond et al. ..... 347/22
5,398,053 A 3/1995 Hirosawa et al.
5,432,539 A * 7/1995 Anderson ..... 347/33
5,530,462 A 6/1996 Takahashi et al.
5,557,306 A * 9/1996 Fukushima et al. ..... 347/33
5,581,284 A 12/1996 Hermanson
5,610,640 A * 3/1997 Anderson et al. ..... 347/32
5,627,571 A 5/1997 Anderson et al.
6,000,792 A * 12/1999 Koizumi et al. ..... 347/33
6,334,662 B2 * 1/2002 Hollands ..... 347/22
6,481,820 B1 11/2002 Tamura et al.
6,547,367 B1 4/2003 Hamada
6,663,215 B2 * 12/2003 Klausbruckner et al. ..... 347/22
6,679,577 B2 * 1/2004 Du et al. ..... 347/23

(Continued)

FOREIGN PATENT DOCUMENTS

EP 1059172 A2 5/2000

(Continued)

OTHER PUBLICATIONS

European Patent Office, European Search Report for Related EP Application No. 06019690 dated Dec. 3, 2007.

*Primary Examiner*—Matthew Luu
*Assistant Examiner*—Shelby Fidler
(74) *Attorney, Agent, or Firm*—Baker Botts, LLP

(57) ABSTRACT

A liquid-droplet jetting apparatus for jetting liquid droplet includes a first liquid-droplet jetting head having a plurality of first nozzles arranged in a predetermined direction; a movable body movable in the predetermined direction relative to the first liquid-droplet jetting head; a driving mechanism which drives the movable body in the predetermined direction; a position detector which detects a position of the movable body with respect to the predetermined direction; and a jetting state detector which is provided on the movable body to move in the predetermined direction integrally with the movable body and which detects a jetting state for each of the first nozzles. Accordingly, it is possible to detect jetting abnormality of a nozzle, among the nozzles, with a simple structure.

22 Claims, 22 Drawing Sheets

U.S. PATENT DOCUMENTS

| | | | | |
|---|---|---|---|---|
| 6,783,209 | B2 * | 8/2004 | Gompertz | 347/29 |
| 2002/0180824 | A1 * | 12/2002 | Endo | 347/19 |
| 2004/0100520 | A1 * | 5/2004 | Kimura | 347/30 |
| 2004/0189735 | A1 * | 9/2004 | Ishii et al. | 347/22 |
| 2004/0189741 | A1 * | 9/2004 | Kimura et al. | 347/33 |

FOREIGN PATENT DOCUMENTS

| | | |
|---|---|---|
| JP | H2 194967 | 8/1990 |
| JP | H6 191020 | 7/1994 |
| JP | H11 334047 | 12/1999 |

* cited by examiner

LIQUID-DROPLET JETTING APPARATUS HAVING A MOVABLE BODY FOR DETECTING AND PURGING ABNORMAL NOZZLES

CROSS REFERENCE TO RELATED APPLICATIONS

The present application claims priority from Japanese Patent Application No. 2005-273055, filed on Sep. 21, 2005, the disclosure of which is incorporated herein by reference in its entirety

BACKGROUND OF THE INVENTION

1. Field of the Invention

The present invention relates to a liquid-droplet jetting apparatus which jets liquid droplets, and a method of recovering a liquid-droplet jetting head.

2. Description of the Related Art

As an ink-jet printer which jets ink to a recording paper or the like, a so-called line-type ink-jet printer is known, which has a plurality of nozzles arranged in a direction (primary scanning direction) orthogonal to a feeding direction (secondary scanning direction) of this recording paper or the like. This line-type ink-jet head has an advantage that the line-type ink-jet head performs recording faster than a serial-type ink-jet head because the line-type ink-jet head is capable of recording by jetting ink from nozzles arranged in a line entirely across the width of the recording paper. On the other hand, since the line-type ink-jet head has a large number of nozzles, when dust, air and/or the like enter in any of the nozzles, jetting abnormality or failure easily occurs, in the line-type ink-jet head, such as that the liquid droplet cannot be jetted (misfiring or non-discharge of liquid droplet); a liquid droplet of the ink is jetted in a direction deviated or bent from an intended jetting direction (bending in the jetting direction), which in turn causes the liquid droplet land on a position deviated from an intended landing position; and the like. When such a jetting abnormality occurs, a while streak or line is formed in a recorded letter or image, thereby degrading the printing quality.

In this case, if a nozzle having jetting abnormality (nozzle at which jetting abnormality occurs, abnormal nozzle) can be identified, it becomes possible to purge only the nozzle, or to complement or compensate for (jet ink instead of) the failed or abnormal nozzle by a normal nozzle of another head, which enables efficient elimination of the jetting abnormality.

For example, Japanese Patent Application Laid-open No. 11-334047 discloses a line-type ink-jet printer having a nozzle checking means for detecting a nozzle in an abnormal jetting state. The nozzle checking means is constituted of a laser light source and a light-receiving element provided at both ends, respectively, of the ink-jet head. Then, liquid droplets are jetted sequentially from a plurality of nozzles in a state that laser light is emitted in parallel to a direction in which the nozzles are arranged (nozzle arrangement direction). When liquid droplets are jetted normally from the nozzles, the laser light is blocked by the liquid droplets, but when liquid droplets are not jetted from the nozzles, or when bending in the jetting direction occurs, the laser light is not blocked by the liquid droplets, so that the nozzle having jetting abnormality can be identified.

Incidentally, in the line-type ink-jet head, bending of the jetting direction (displacement or deviation from landing position) of liquid droplets in the arrangement direction of nozzles, which is orthogonal to the feeding direction of a recording paper, generates a white line or streak on a recording paper in parallel to the feeding direction for the recording paper, which can significantly affect the printing quality as compared to bending of the jetting direction with respect to the paper feeding direction. However, in the ink-jet printer disclosed in the Japanese Patent Application Laid-open No. 11-334047, since the laser light is emitted from the laser light source in parallel to the arrangement direction of the nozzles, it is not possible to detect bending of the jetting direction with respect to the arrangement direction of the nozzles.

In view of the above situation, when an attempt is made to emit laser light in parallel to the paper feeding direction to each of all the arranged nozzles so as to detect bending of the jetting direction in the arrangement direction of the nozzles, it is necessary to provide the nozzle check means constructed of the laser light source and the light-receiving element for each of the nozzles. As a result, the structure becomes large and the costs of parts increase.

SUMMARY OF THE INVENTION

An object of the present invention is to provide a liquid-droplet jetting apparatus capable of securely detecting a jetting state of each of the nozzles with a detector having a simple structure.

According to a first aspect of the present invention, there is provided a liquid-droplet jetting apparatus for jetting liquid droplet, including: a first liquid-droplet jetting head having a plurality of first nozzles arranged in a predetermined direction; a movable body movable in the predetermined direction relative to the first liquid-droplet jetting head; a driving mechanism which drives the movable body in the predetermined direction; a position detector which detects a position of the movable body with respect to the predetermined direction; and a jetting state detector which is provided on the movable body to move in the predetermined direction together with the movable body and which detects a jetting state for each of the first nozzles.

According to this construction, jetting states of all the first nozzles can be detected by the jetting state detector which is movable integrally with the movable body in the arrangement direction of the first nozzles. Accordingly, a first nozzle, among the first nozzles, which has jetting abnormality (or at which jetting abnormality occurs) can be identified. Further, the structure is simpler as compared to the case that the jetting state detector is provided for each of all the first nozzles, and also the number of parts decreases, thereby making is possible to lower the manufacturing costs of the liquid-droplet jetting apparatus.

In the liquid-droplet jetting apparatus according to the present invention, the jetting state detector may have a light-emitting element which emits light in a direction crossing the predetermined direction and a light-receiving element which receives the light from the light-emitting element; and the light emitted from the light-emitting element to the light-receiving element may be blocked by liquid droplets jetted from the first nozzles. According to this structure, since light is emitted from the light-emitting element so as to cross the arrangement direction of the first nozzles, it is possible to detect whether or not bending of the jetting direction (displacement of landing position or deviation from the landing position) in the nozzle arrangement direction occurs in each of the nozzles simply and securely, by whether or not the light from the light-emitting element is blocked momentarily by liquid droplets.

In the liquid-droplet jetting apparatus according to the present invention, the first liquid-droplet jetting head may have a liquid droplet jetting surface in which jetting ports of the first nozzles are arranged in the predetermined direction; the liquid-droplet jetting apparatus may further include a purge cap covering only a part of the liquid droplet jetting surface, and a discharge forcing unit which forcibly discharges a liquid from a jetting port of a first nozzle among the first nozzles which is located at the part covered by the purge cap; and the purge cap may be provided on the movable body and may be movable in the predetermined direction integrally with the movable body.

Since only a part of the first nozzles including a first nozzle having jetting abnormality can be covered by the purge cap, and only the part of the first nozzles can be purged by discharging liquid forcibly, there is no need to purge other nozzles in a normal jetting state. Further, when the nozzle having jetting abnormality is purged, the liquid discharged from the first nozzle does not adhere to the vicinity of jetting ports of other nozzles not covered by the purge cap, and thus occurrence of jetting abnormality in other nozzles can be prevented. Furthermore, since the purge cap is provided on the movable body together with the jetting state detector, it is not necessary to provide a driving mechanism and a position detector for moving the purge cap to the position of the first nozzle having jetting abnormality, which simplifies the structure.

In the liquid-droplet jetting apparatus according to the present invention, when the jetting state detector detects that a jetting state of a first nozzle among the first nozzles is abnormal, the purge cap may cover an area, on the liquid droplet jetting surface, which includes a jetting port of the first nozzle detected to be abnormal. According to this structure, when a jetting state of a certain first nozzle is detected to be abnormal, this nozzle can be purged instantly to recover from the jetting abnormality. Therefore, the time needed for the entire maintenance operation including a detecting operation of jetting abnormality and a recovery operation thereof becomes short.

In the liquid-droplet jetting apparatus according to the present invention, a relationship of $W=nP$ (n is natural number) may be established in which W is a width of the purge cap in the predetermined direction and P is a pitch at which the first nozzles are arranged with respect to the predetermined direction. According to this structure, when the purge cap covers jetting ports of a part of the first nozzles, it is possible to prevent edges of the purge cap from interfering with first nozzles adjacent to the part of the first nozzles.

In the liquid-droplet jetting apparatus according to the present invention, the movable body may be provided with a cap driving mechanism which moves the purge cap between a purge position at which the purge cap covers the part of the liquid droplet jetting surface and a purge standby position which is apart from the liquid droplet jetting surface; and the purge cap may be at the purge standby position when a jetting state of a first nozzle of the first nozzles is detected by the jetting state detector; and further when the purge cap driven by the cap driving mechanism moves from the purge standby position to the purge position, the movable body may be at a position at which the purge cap covers a jetting port of the first nozzle being detected. According to this structure, when abnormality of a jetting state of a certain first nozzle is detected, the nozzle detected to be abnormal can be purged by just moving the purge cap from the purge standby position to the purge position without moving the movable body.

In the liquid-droplet jetting apparatus according to the present invention, after the liquid is discharged by the discharge forcing unit forcibly from the first nozzle covered by the purge cap, the jetting state detector may detect a jetting state of the first nozzle again. According to this structure, after a nozzle in an abnormal jetting state is purged, it is possible to confirm whether or not the nozzle is recovered from the abnormal state.

In the liquid-droplet jetting apparatus according to the present invention, the movable body may be provided with a wiper which wipes the liquid adhering to the liquid droplet jetting surface. According to this structure, since liquid droplet or droplets adhering to the liquid droplet jetting surface can be wiped by the wiper by moving the movable body after purging the nozzles, a structure for moving the wiper relative to the liquid droplet jetting surface is not necessary.

The liquid-droplet jetting apparatus according to the present invention may further include: a second liquid-droplet jetting head which has a second nozzle and which is movable in the predetermined direction: a head drive mechanism which drives the second liquid-droplet jetting head in the predetermined direction; and a head position detector which detects a position of the second liquid-droplet jetting head with respect to the predetermined direction; wherein when the jetting state detector detects that a jetting state of a first nozzle among the first nozzles is abnormal, the second liquid-droplet jetting head may be moved to a position corresponding to a position of the first nozzle, and a liquid droplet may be jetted from the second nozzle instead of the first nozzle. According to this structure, when a jetting state of a certain first nozzle is abnormal, the second liquid-droplet jetting head can be moved to a position corresponding to the first nozzle to jet liquid droplet from the second nozzle of the second liquid-droplet jetting head instead of the first nozzle.

According to a second aspect of the present invention, there is provided a liquid-droplet jetting apparatus fox jetting liquid droplet, including: a liquid-droplet jetting head having a plurality of nozzles arranged in a predetermined direction; and a movable body which moves in the predetermined direction relative to the liquid-droplet jetting head; wherein the movable body has a detector which detects jetting states of the nozzles, and a purge cap which covers jetting ports of the nozzles.

In the liquid-droplet jetting apparatus according to the present invention, the detector may have a light-emitting element which emits light in a direction crossing the predetermined direction and a light-receiving element which receives the light from the light-emitting element; and the light emitted from the light-emitting element to the light-receiving element may be blocked by liquid droplets jetted from the nozzles.

In the liquid-droplet jetting apparatus according to the present invention, the purge cap may cover an area including a jetting port of a nozzle, among the nozzles, detected to be abnormal by the detector. Alternatively, the apparatus may further include a discharge forcing unit which forcibly discharges a liquid from the jetting ports of the nozzles covered by the purge cap. According to this structure, only a part of the nozzles including a nozzle having jetting abnormality can be covered by the purge cap, and only the part of the nozzles can be purged by discharging liquid forcibly therefrom. Accordingly, other nozzles in a normal jetting state are not needed to be purged. Further, when the nozzle having jetting abnormality is purged, the liquid discharged from the nozzle does not adhere to the vicinity of jetting ports of other nozzles not covered by the purge cap, and thus jetting abnormality can be prevented from occurring in other nozzles.

In the liquid-droplet jetting apparatus according to the present invention, the movable body may be provided with a wiper which wipes a liquid adhering to the liquid-droplet jetting head. According to this structure, liquid droplet or droplets adhering to the liquid droplet jetting surface can be wiped by the wiper by moving the movable body after purging the nozzles. Accordingly, a structure for moving the wiper relative to the liquid droplet jetting surface is not necessary.

According to a third aspect of the present invention, there is provided a method of recovering a liquid-droplet jetting head for jetting liquid droplet and having a plurality of nozzles arranged in a predetermined direction, the method including: moving a detector along the liquid-droplet jetting head; detecting abnormality of the nozzles by the detector; and covering and purging a nozzle, among the nozzles, detected to be abnormal, with a purge cap.

The method of recovering the liquid-droplet jetting head according to the present invention may further include, after the nozzle detected to be abnormal is purged, detecting again a jetting state of the purged nozzle. Accordingly, after purging a certain nozzle among the nozzles in an abnormal jetting state, it is possible to confirm whether or not the purged nozzle is recovered from the abnormal state.

In the method of recovering the liquid-droplet jetting head according to the present invention, the detector may include a light-emitting element which emits light in a direction crossing the predetermined direction and a light-receiving element which receives the light from the light-emitting element.

DETAILED DESCRIPTION OF THE PREFERRED EMBODIMENTS

An embodiment of the present invention will be explained. This embodiment is an example in which the present invention is applied to an ink-jet printer, as a liquid-droplet jetting apparatus, provided with a line-type ink-jet head which jets ink to a recording paper.

Figure 1:
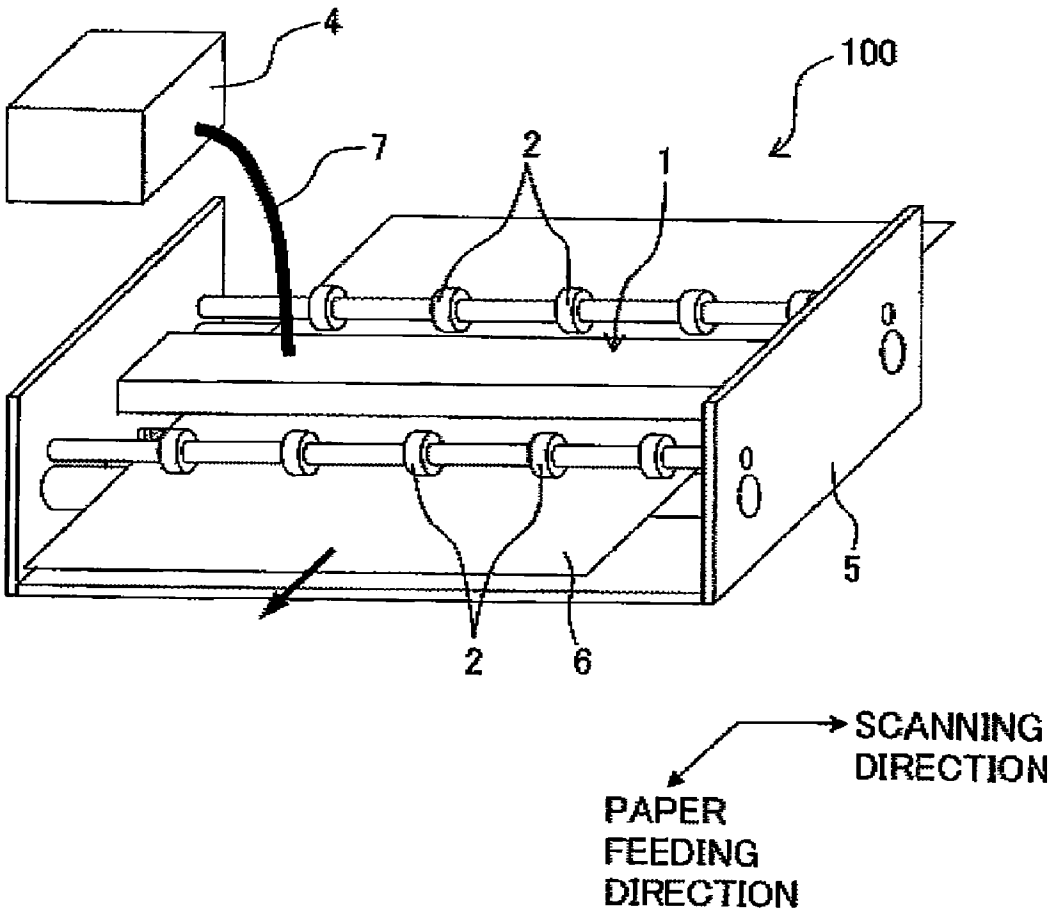
FIG. 1 is a perspective view showing a schematic structure of an ink-jet printer according to an embodiment of the present invention.

First, the schematic structure of an ink-jet printer 100 of the embodiment will be explained. As shown in FIG. 1, the ink-jet printer 100 has an ink-jet head 1 (first liquid-droplet jetting head) which is an line-type head supported at both end thereof in a printer body 5 and which extends in a width direction of recording paper 6 (scanning direction; left and right direction in FIG. 1); feeding rollers 2 which feed or transport the recording paper 6 in a forward direction in FIG. 1; a control unit 3 (see FIG. 9) which controls the entire ink-jet printer 10; and the like. The ink-jet head 1 jets an ink, supplied from an ink tank 4 via a tube 7, through a plurality of nozzles 20 (see FIGS. 2 to 5) which are arranged in arrays or rows in the scanning direction, onto the recording paper 6 so as to record a desired letter and/or image on the recording paper 6. The recording paper 6, on which the letter and/or image has been recorded by the ink-jet head 1, is discharged in the forward direction (paper feeding direction) by the feeding roller 2 driven and rotated by a feed motor 8 (see FIG. 9)

Next, the ink-jet head 1 will be explained. As shown in FIGS. 2 to 5, the ink-jet head 1 is provided with a channel unit 200 in which an ink channel including the nozzles 20 and pressure chambers 14 is formed; and a piezoelectric actuator 300 which is arranged on an upper surface of the channel unit 200 and which applies a jetting pressure to the ink in the pressure chambers 14.

Figure 4:
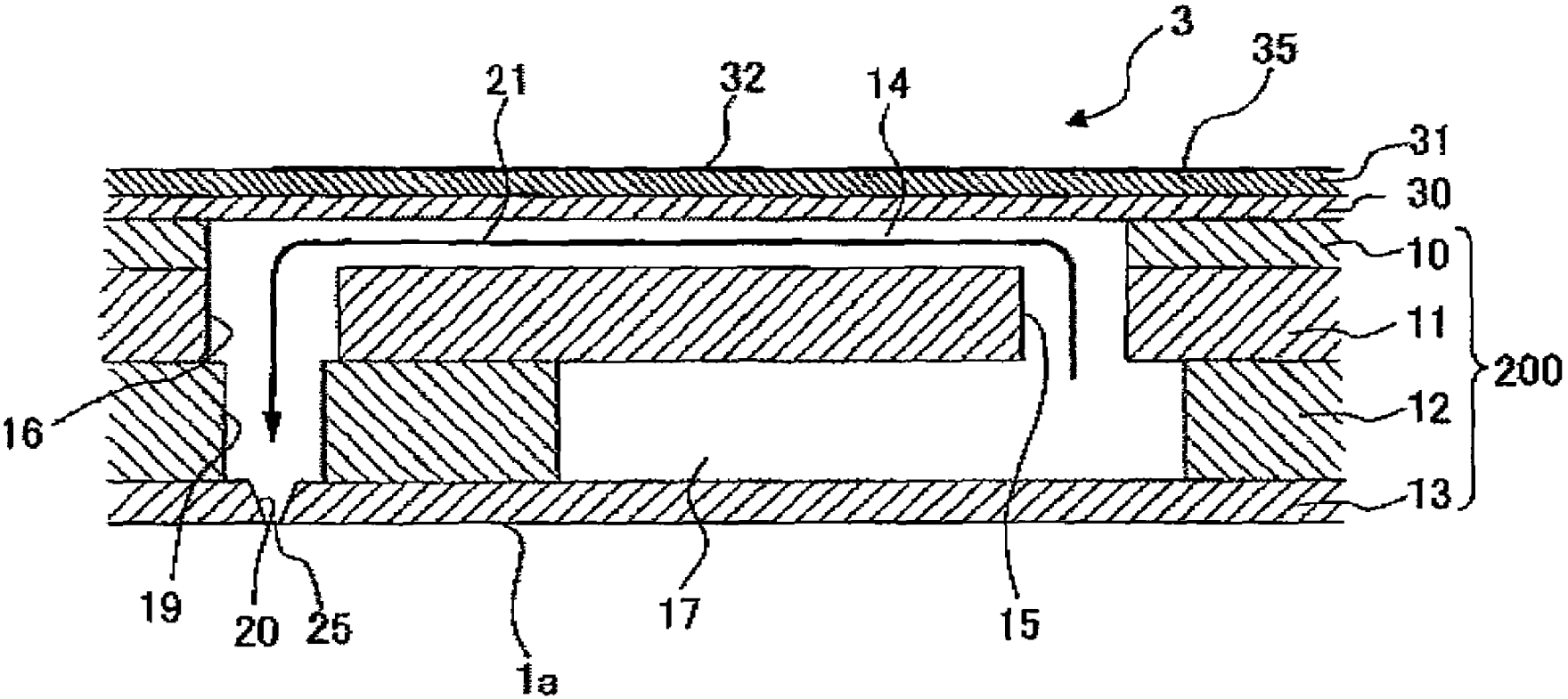
FIG. 4 is a cross-sectional view taken along a line IV-IV in FIG. 3.
Figure 5:
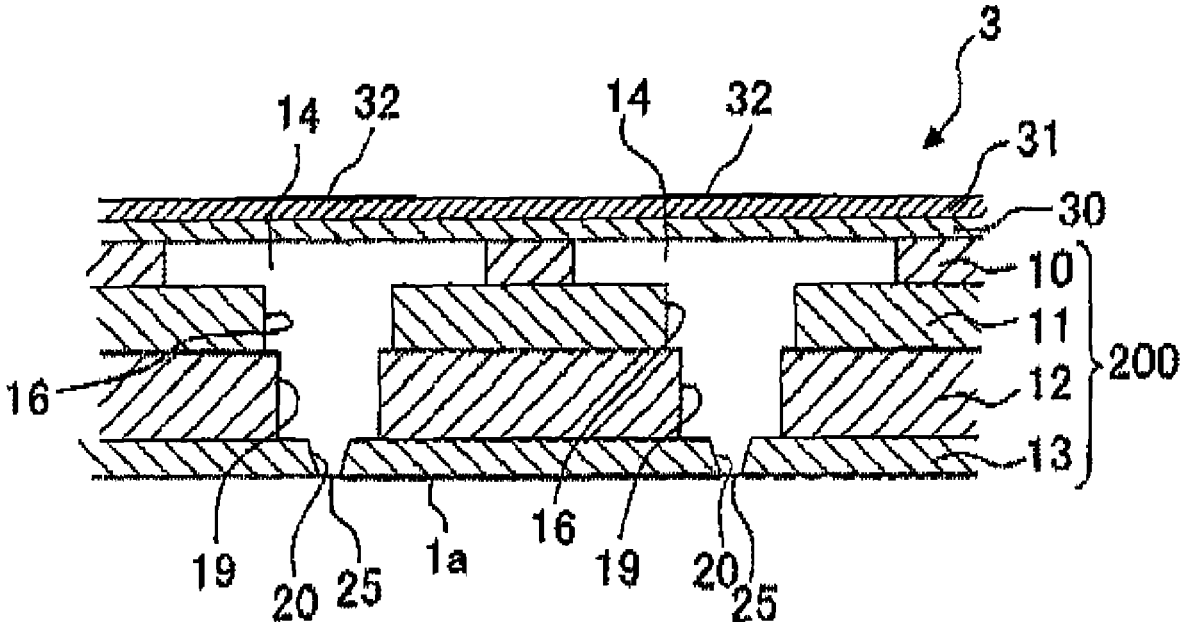
FIG. 5 is a cross-sectional view taken along a line V-V in FIG. 3.

First, the channel unit 200 will be explained. As shown in FIGS. 4 and 5, the channel unit 200 is provided with a cavity plate 10, a base plate 11, a manifold plate 12, and a nozzle plate 13, and these four plates 10 to 13 are joined together in stacked layers. Among these plates, the cavity plate 10, the base plate 11 and the manifold plate 12 are plates made of stainless steel. The ink channel such as the pressure chambers 14, a manifold 17 which will be explained later, and the like are easily formed in these plates 10 to 12 by etching. Further, the nozzle plate 13 is formed, for example, of a high-molecular synthetic material such as polyimide, and is adhered on a lower surface of the manifold plate 12. Alternatively, this nozzle plate 13 may be also formed of a metallic material such as stainless steel similarly to the three plates 10 to 12.

As shown in FIGS. 2 to 5, among the four plates 10 to 13, the cavity plate 10 located at the uppermost position in the stacked plates has a plurality of pressure chambers 14 which are formed in the cavity plate 10 in a shape of through holes penetrating through the cavity plate 10 and are arranged in rows or arrays on a plane. Each of the pressure chambers 14 is covered by a vibration plate 30 which will be explained later and by the base plate 11 from above and below, respectively. Also, the pressure chambers 14 are arranged in four rows or arrays in the scanning direction (left and right direction in FIG. 2). Each of the pressure chambers 14 is formed in an elliptic shape which is long in the paper feeding direction (up and down direction in FIG. 2) in a plan view.

Communication holes 15 and 16 are formed in the base plate 11 at positions overlapping in a plan view with both ends, respectively, of one of the pressure chambers 14. Further, three manifolds 17 extending in the scanning direction (left and right direction in FIG. 2) are formed in the manifold plate 12. The manifolds 17 partially overlaps in a plan view with the pressure chambers 14 arranged in the scanning direction. Furthermore, the manifolds 17 communicate with an ink supply hole 18 formed in the vibration plate 30 which will be explained later, and the ink is supplied to the manifolds 17 from the ink tank 4 (see FIG. 1) via the ink supply hole 18. Moreover, a plurality of communication holes 19, communicating to the communication holes 16 respectively, are also formed in the manifold plate 12 at positions each overlapping in a plan view with an end of one of the pressure chambers 14, on a side opposite to one of the manifolds 17.

Figure 2:
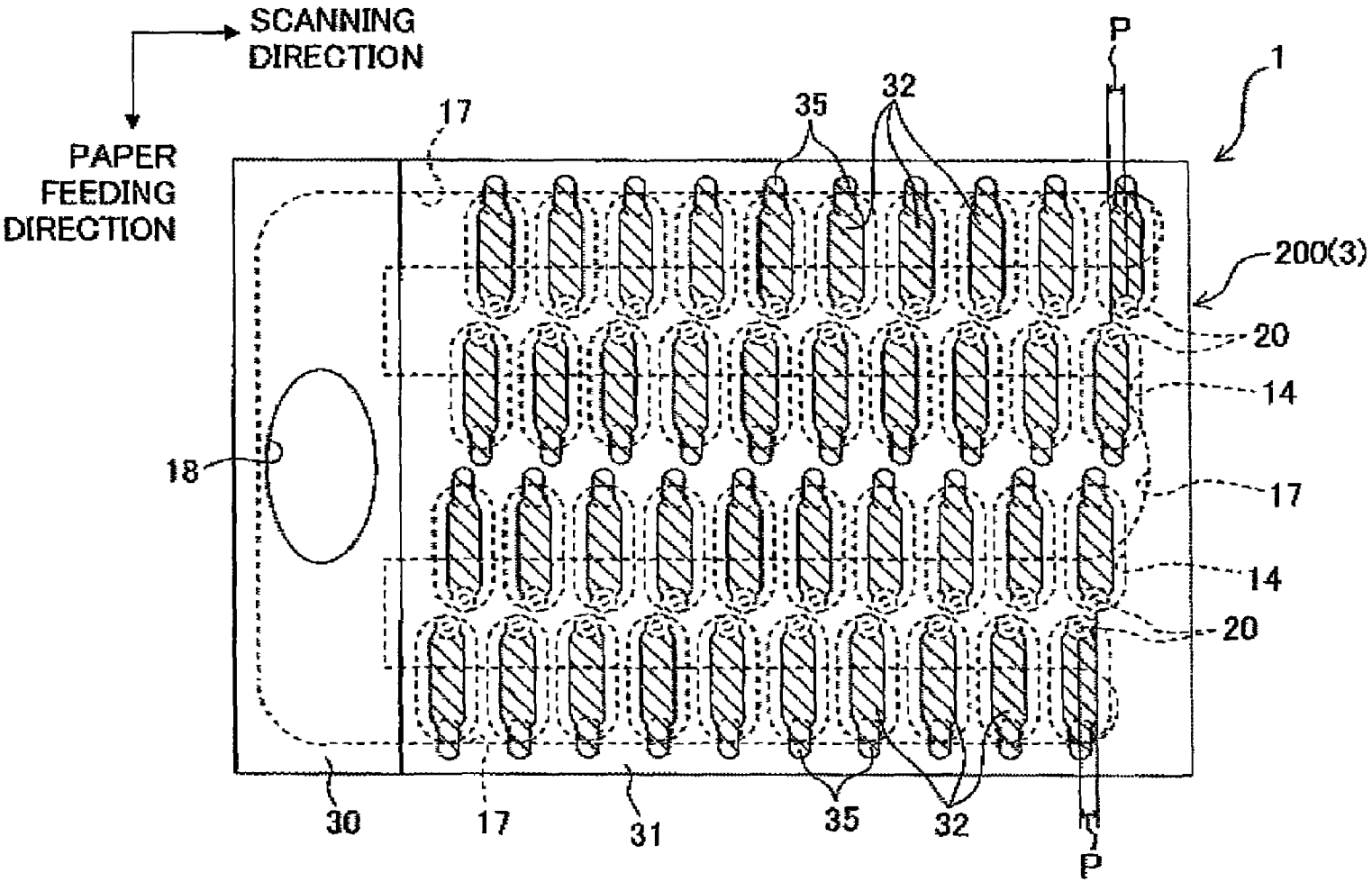
FIG. 2 is a plan view of an ink-jet head.
Figure 3:
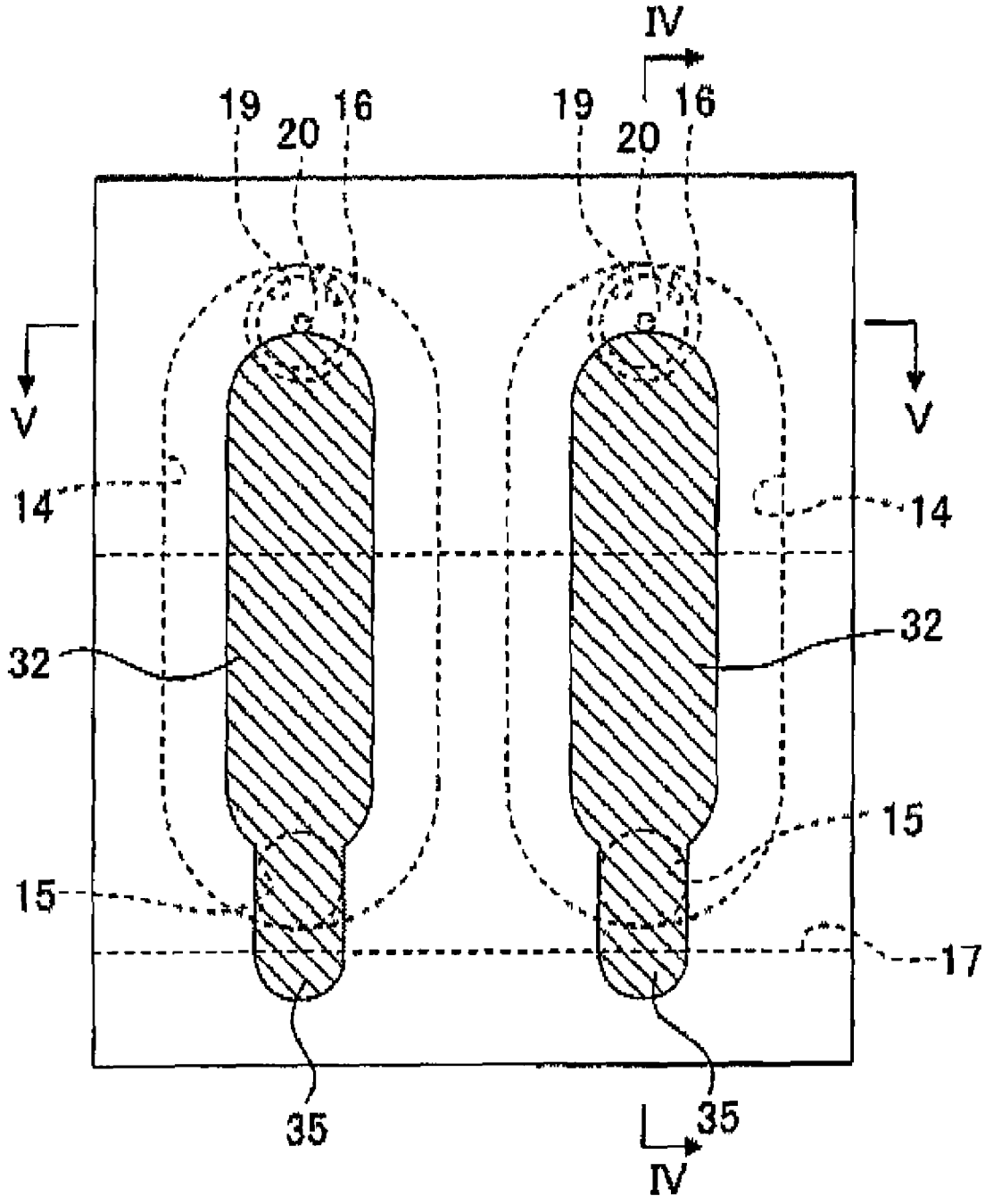
FIG. 3 is a partially enlarged view of FIG. 2.

Further, a plurality of nozzles 20 are formed in the nozzle plate 13 at positions each overlapping in a plan view with one of the communication holes 19. As shown in FIG. 2, each of the nozzles 20 is overlapped with the one end, of one of the pressure chambers 14 arranged in the four rows or arrays, on the side opposite to one of the manifolds 17, and the nozzles 20 are arranged in four rows or arrays in the scanning direction (left and right direction in FIG. 2) in areas between the three manifolds 17. Further, as shown in FIG. 2, between adjacent nozzle rows among the nozzle rows, nozzles 20 each belongs to one of the adjacent two rows are arranged at positions, with respect to the nozzle arranging direction, shifted from each other by amount of "P". In other words, when viewed from the paper feeding direction, the nozzles 20 aligned in four rows are arranged by a pitch P (see FIG. 7). Note that a lower surface of the nozzle plate 13 is a liquid droplet jetting surface 1*a* on which jetting ports 25 of the nozzles 20 are arranged in the scanning direction. Further, as shown in FIG. 4 and FIG. 5, the nozzles 20 are formed in a tapered shape (tapered), and an axis thereof is in parallel to the vertical direction. Therefore, when the nozzles 20 are normal, liquid droplets are jetted from the nozzles 20 downward in the vertical direction.

Thus, as shown in FIG. 4, each of the manifolds 17 communicates with one of the pressure chambers 14 via one of the communication holes 15, and each of the pressure chambers 14 communicates with one of the nozzles 20 via the communication holes 16, 19. In this manner, in the channel unit 200, a plurality of individual ink channels 21 each from one of the manifolds 17 to one of the nozzles 20 via one of the pressure chambers 14.

Next, the piezoelectric actuator 300 will be explained. As shown in FIGS. 2 to 5, the piezoelectric actuator 300 has a vibration plate 30 arranged on the upper surface of the channel unit 200; a piezoelectric layer 31 formed continuously on the upper surface of the vibration plate 30 so as to cover the pressure chambers 14; and a plurality of individual electrodes 32 which are formed on the upper surface of the piezoelectric layer 31 to correspond to the pressure chambers 14, respectively.

The vibration plate 30 is substantially rectangular in a plan view, and is an electrically conductive plate formed of a metallic material such as an iron alloy like stainless steel, a copper alloy, a nickel alloy, a titanium alloy, or the like. The vibration plate 30 is arranged on the upper surface of the cavity plate 10 so as to cover the pressure chambers 14, and is adhered to the cavity plate 10. Further, the vibration plate 30 is always kept at ground potential, and functions also as a common electrode which makes an electric field act in the piezoelectric layer 31 between the individual electrodes 32 and the vibration plate 30, in a thickness direction of the piezoelectric layer 31.

On the upper surface of the vibration plate 30, the piezoelectric layer 31, mainly composed of a lead zirconate titanate (PZT) which is a ferroelectric solid solution of lead zirconate and lead titanate. The piezoelectric layer 31 is formed continuously so as to cover the pressure chambers 14. The piezoelectric layer 31 can be formed, for example, by an aerosol deposition method (AD method) in which ultra-fine particulate material is collided onto an objective surface so as to make the particulate material to deposit on the objective surface. Other than the AD method, the piezoelectric layer 31 can be also formed by using a method such as a sol-gel method, a sputtering method, a hydrothermal synthesis method, a CVD (chemical vapor deposition) method, or the like. Still alternatively, the piezoelectric layer 31 can be formed by cutting a piezoelectric sheet, obtained by calcinating a green sheet of PZT, and then by bonding the piezoelectric sheet to the vibration plate 30.

On the upper surface of the piezoelectric layer 31, the individual electrodes 32 are formed to correspond to the pressure chambers 14, respectively. Each of the individual electrodes 32 is substantially ecliptic in a plan view, is smaller to some extent than one of the pressure chambers 14 in a plan view, and is formed at a position overlapping in a plan view with a central portion of one of the pressure chambers 14 to which the individual electrode 32 corresponds. Further, the individual electrodes 32 are formed of an electrically conductive material such as gold, copper, silver, palladium, platinum, titanium, or the like. Furthermore, a plurality of contact points 35 are drawn each from one end of one of the individual electrodes 32 (one end of one of the individual electrodes 32 on the side of the manifold 17). These contact points 35 are connected to contact points, respectively, of a flexible wiring member (not shown) such as a flexible printed circuit (FPC) or the like. The individual electrodes 32 are electrically connected via this wiring member to a driver IC 22 (see FIG. 9) which applies a drive voltage selectively to the individual electrodes 32. The individual electrodes 32 and the contact points 35 can be formed by a method such as screen printing, the sputtering method, a vapor deposition method, or the like.

Next, the operation of the piezoelectric actuator 300 upon jetting the ink will be explained. When a drive voltage is applied from the driver IC 22 selectively to the plurality of individual electrodes 32, a potential difference is generated between a certain individual electrode 32 among the individual electrodes 32, which is disposed on the piezoelectric layer 31 and to which the drive voltage is applied, and the vibration plate 30 as the common electrode which is disposed under the piezoelectric layer 31 and maintained at ground potential, thereby generating an electric field in a thickness direction of the piezoelectric layer 31 in a portion of the piezoelectric layer 31 sandwiched between the individual electrode 32 and the vibration plate 30. At this time, when a direction in which the piezoelectric layer 31 is polarized and the direction of the electric field are same, the portion of the piezoelectric layer 31, which is positioned directly below the individual electrode 32 applied with the drive voltage, expands in the thickness direction in which the piezoelectric layer 31 is polarized and contracts in a horizontal direction (direction parallel to the plane of the piezoelectric layer 31 and orthogonal to the polarization direction). Then, accompanying with the contracting deformation of the piezoelectric layer 31, the vibration plate 30 is deformed to project toward a pressure chamber 14, among the pressure chambers 14, corresponding to the individual electrode 32. Accordingly, the volume of the pressure chamber 14 is decreased to apply pressure to the ink in the pressure chamber 14, thereby jetting a droplet of the ink (ink droplet) from a nozzle 20 communicating with the pressure chamber 14.

In this case, as described above, the line-type ink-jet head 1 has a large number of nozzles 20 in a direction orthogonal to the paper feeding direction. Therefore, when a foreign matter such as dust and/or air enter and mix in any of the nozzles 20, the jetting abnormality is easily occur such that the liquid droplet of the ink cannot be jetted (non-jetting of the ink) from the nozzle 20 into which the dust and/or air entered; a liquid droplet of the ink is jetted from the nozzle 20 deviated or bent in an intended jetting direction (bending of the jetting direction) and thus the liquid droplet lands on a position deviated or displaced from an intended landing position; or the like. When the recording is performed in a state that such a jetting abnormality occurs at any of the nozzles 20, a white streak or line is formed in a recorded letter, image, and the like, thereby lowering the printing quality. Accordingly, the ink-jet printer 100 of this embodiment is constructed to be capable of performing a maintenance operation to recover from the jetting abnormality by forcibly discharging ink from the jetting port 25 of the nozzle 20 having jetting abnormality (nozzle purging).

Here, nozzle purging in a conventional ink-jet printer is generally performed such that a purge cap is attached on a liquid droplet jetting surface of an ink-jet head to cover jetting ports of all nozzles thereof, and the ink is discharged simultaneously from all the nozzles to the purge cap. However, with such a purging method, there is a fear that the ink, which is discharged from a nozzle and is bubbled, adheres to a portion in the vicinity of the jetting port of another nozzle in a normal jetting state (not in need of purging); and further that this ink is sucked into the another nozzle when negative pressure is generated on the upstream side of the ink channel, which in turn causes air to enter the another nozzle in a normal jetting state, thereby generating jetting abnormality also in the another nozzle. In other words, even when the nozzle having jetting abnormality is purged and its jetting state is recovered, this purging results in generating jetting abnormality in another nozzle in a normal jetting state.

Accordingly, the ink-jet printer 100 of this embodiment is constructed to be capable of identifying a nozzle 20, among the nozzles 20, which is in an abnormal jetting state and of purging only a part of the nozzles 20 including the abnormal nozzle 20.

Figure 6:
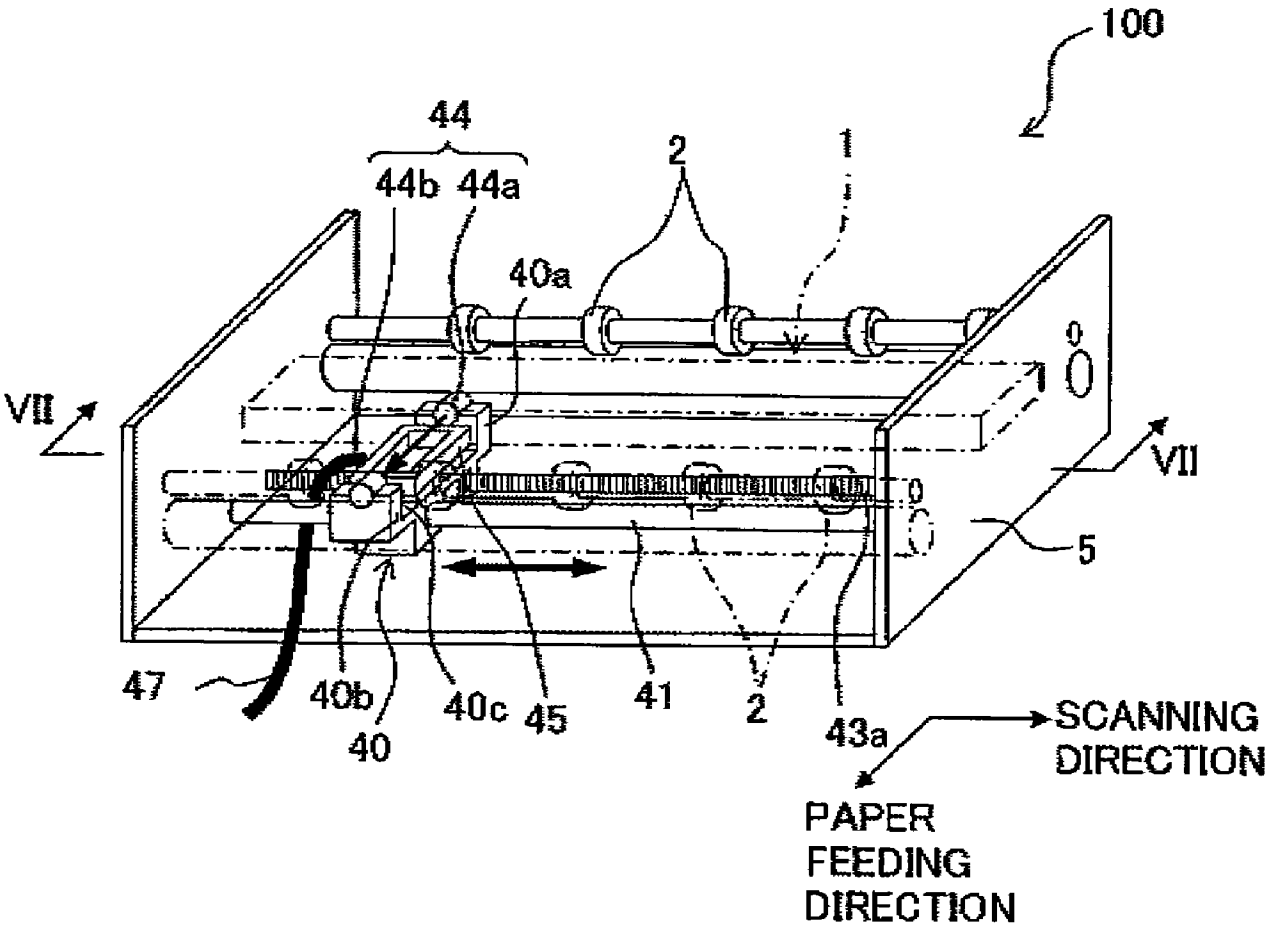
FIG. 6 is a perspective view showing a structure for performing a maintenance operation of the ink-jet printer.
Figure 7:
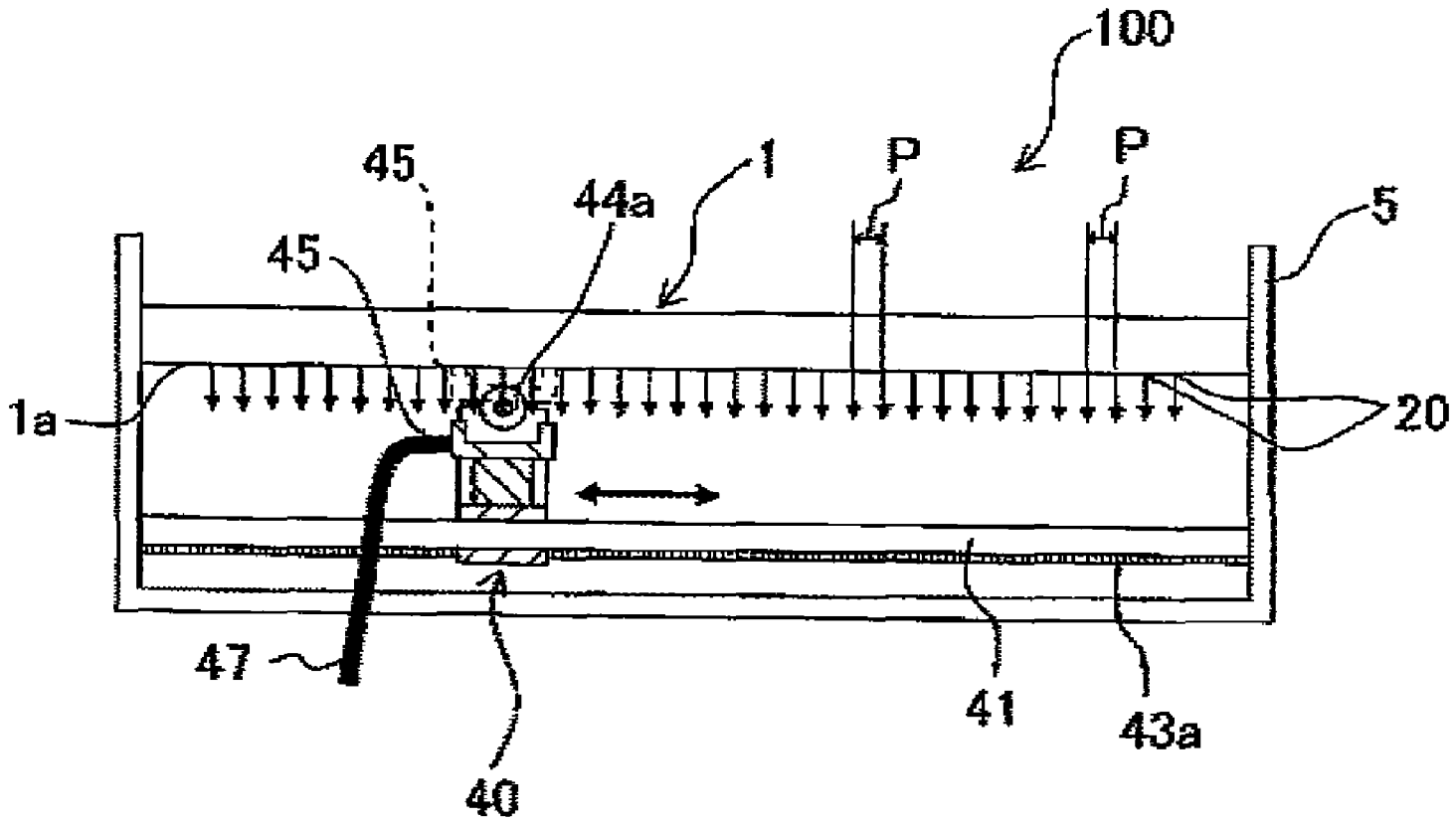
FIG. 7 is a cross-sectional view taken along a line VII-VII in FIG. 6.

As shown in FIGS. 6 and 7, a movable body 40 facing an liquid-droplet jetting surface 1*a* of the ink-jet head 1 is arranged at a position immediately below the ink-jet head 1 to be movable along a guide shaft 41, with respect to the ink-jet head 1, in the scanning direction (the direction in which the nozzles 20 are arranged). The movable body 40 is driven in the scanning direction by a movable body driving motor 42 (drive mechanism: see FIG. 9). Further, the ink-jet head 1 also includes a scale 43*a*, and a linear encoder 43 (position detector: see FIG. 9) which detects a position of the movable body 40 in the scanning direction is provided. The scale 43*a* is arranged parallel to the scanning direction. When printing is performed by jetting the ink onto the recording paper 6 from the nozzles 20 of the ink-jet head 1, the movable body 40 is located (standing by) at a stand-by position at one side (right side in FIG. 6) in the scanning direction with respect to a feeding passage for the recording paper 6. On the other hand, when a command for detecting the jetting state is inputted to the control unit 3 (see FIG. 9) of the ink-jet printer 100, the movable body 40 is moved leftward from the stand-by position so as to cross over (traverse across) the feeding passage.

On the upper portion of the movable body 40, a jetting-state detector 44, which detects the jetting state of each of the nozzles 20, is provided. The jetting-state detector 44 has a light emitting element 44*a* which is arranged on a wall 40*a* located at the far end (upstream in the paper feeding direction in FIG. 6) of the movable body 40, and which emits laser beam in a forward direction (direction orthogonal to the direction in which the nozzles are arranged); and a light receiving element 44*b* which is arranged on a wall 40*b* located at the front end (downstream in the paper feeding direction in FIG. 6) of the movable body 40, and which receives the laser beam emitted from the light emitting element 44*a*. The jetting-state detector 44 is movable integrally with the movable body 40 in the scanning direction. Then, as shown in FIG. 7, when a liquid droplet is jetted from a certain nozzle 20, of the nozzles 20, normally (downwardly in the vertical direction) in a state that the movable body 40 is located at a position immediately below the certain nozzle 20 (at a position extended from the axis line of the certain nozzle 20), then a laser beam emitted from the light emitting element 44*a* in the forward direction is momentarily blocked by the liquid droplet jetted downwardly in the vertical direction, thereby interrupting the light reception by the light receiving element 44*b*. Thus, the jetting state of the certain nozzle 20 is detected to be normal. On the other hand, when a liquid droplet is not jetted from this nozzle 20 normally or when the liquid droplet is jetted deviated or bent in the scanning direction, the laser beam emitted in the forward direction from the light emitting element 44*a* is not blocked by the liquid droplet and thus the light reception by the light receiving element 44*b* is not interrupted (disturbed). Thus, the jetting state of this nozzle is detected to be abnormal. Then, it is possible to identify a nozzle 20 in which the jetting state is abnormal, by performing a series of these operations for all of the nozzles 20 while moving the movable body 40.

Moreover, in a recess 40*c* located at a center portion between the two walls 40*a*, 40*b* of the movable body 40, there is provided a purge cap 45 which has a rectangular shape in a plan view and is elongated in a front and back (anterior and posterior) direction (paper feeding direction), and the purge cap 45 is movable in the scanning direction integrally with the movable body 40. Further, the movable body 40 is provided with a cap driving motor 46 (cap driving mechanism: see FIG. 9) which drives the purge cap 45 vertically. The purge cap 45 is constructed to be movable from a purge position (position indicated by dashed lines in FIG. 7) on an upper side at which the purge cap 45 makes contact with the liquid droplet jetting surface 1*a* to a purge standby position (position indicated by solid lines in FIG. 7) at which the purge cap 45 is accommodated in the recess 40*c* below the liquid droplet jetting surface 1*a* by being driven by the cap driving motor 46. Note that the purge cap 45 is formed with a material having a certain level of flexibility such as a synthetic resin material, a rubber material or the like so as to be capable of closely and securely contact the liquid droplet jetting surface 1*a*.

Figure 8:
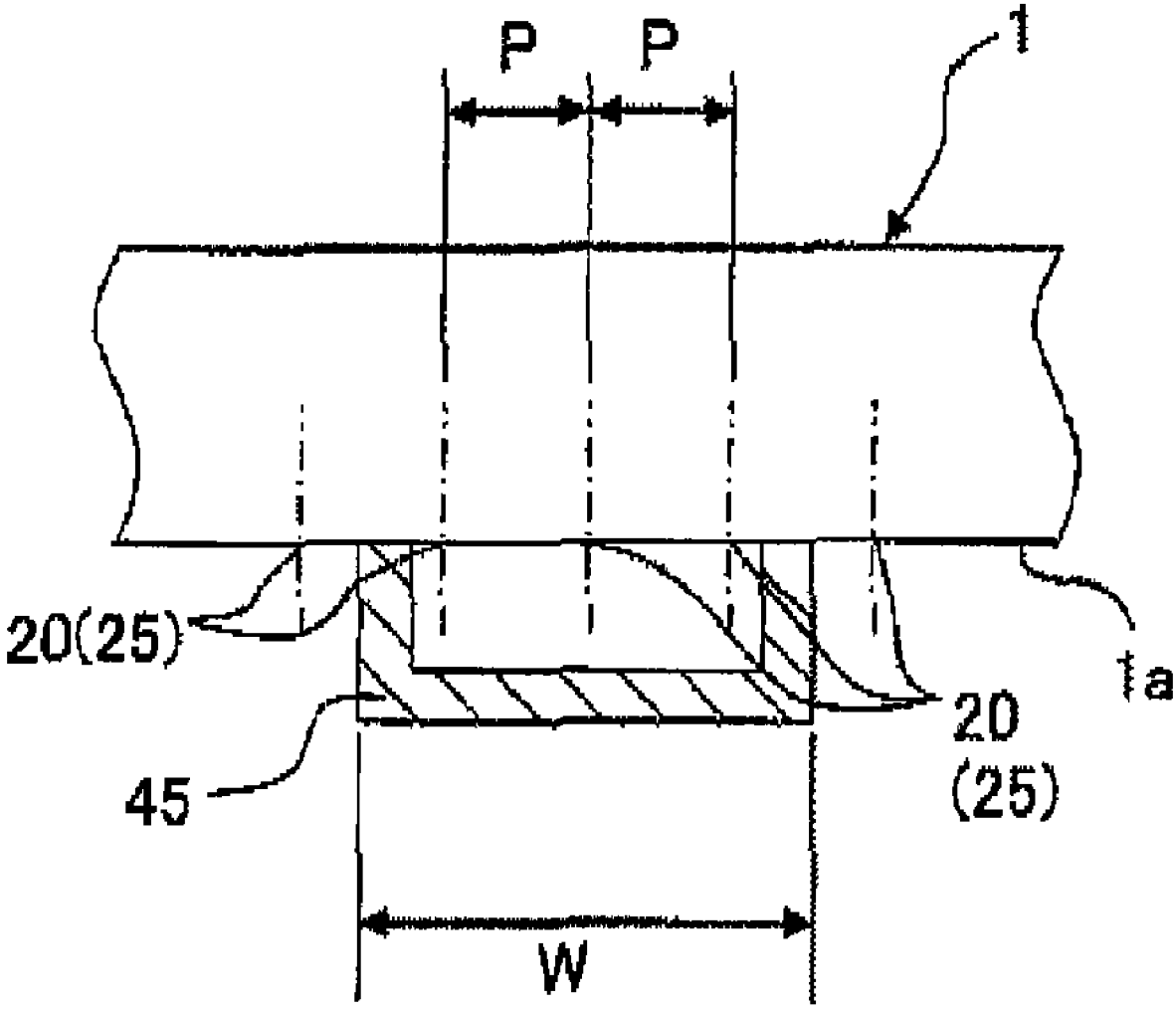
FIG. 8 is a partially enlarged view of FIG. 7 in a state that a purge cap is at a purge position.

As shown in FIG. 6, the length of the purge cap 45 in a longitudinal direction of the purge cap 45 (paper feeding direction) is greater than the length of the ink-jet head 1 in the paper feeding direction. Further, as shown in FIG. 8, a width (length in the scanning direction) W of the purge cap 45 is three times the pitch P for the nozzles 20 viewed from the paper feeding direction (position indicated by chain lines in FIG. 7), that is, W=3P. Then, when the purge cap 45 is at the purge position, only an area in the vicinity of the jetting ports 25 of three nozzles 20, among the nozzles 20, which are adjacent to each other by a spacing distance of the pitch P in the scanning direction is covered by the purge cap 45. Further, at this time, a center portion in the scanning direction of the purge cap 45 is located immediately below the center nozzle 20 among the three nozzles 20 covered by the purge cap 45. Accordingly, as shown in FIG. 8, edges of the purge cap 45 at the purge position do not overlap and interfere with jetting ports 25 of two nozzles 20 adjacent to both sides in the scanning direction of the three nozzles 20 covered by the purge cap 45.

Further, as shown in FIG. 6 and FIG. 7, to the purge cap 45, a suction pump 48 (discharge forcing unit; see FIG. 9) is connected via a tube 47. Then, in a state that the purge cap 45 is at the purge position, by sucking the ink inside the three nozzles 20 covered by the purge cap 45 with the suction pump 48, the ink can be discharged forcibly from these nozzles 20 to the purge cap 45.

Moreover, a nozzle 20 among the nozzles 20 which is in an abnormal jetting state is identified by the above-described movable body 40, jetting state detector 44, purge cap 45, suction pump 48, and the like; and further a series of maintenance operations to purge the jetting nozzle 20 in an abnormal jetting state is controlled by the control unit 3 which serves to control the entire ink-jet printer 100.

Figure 9:
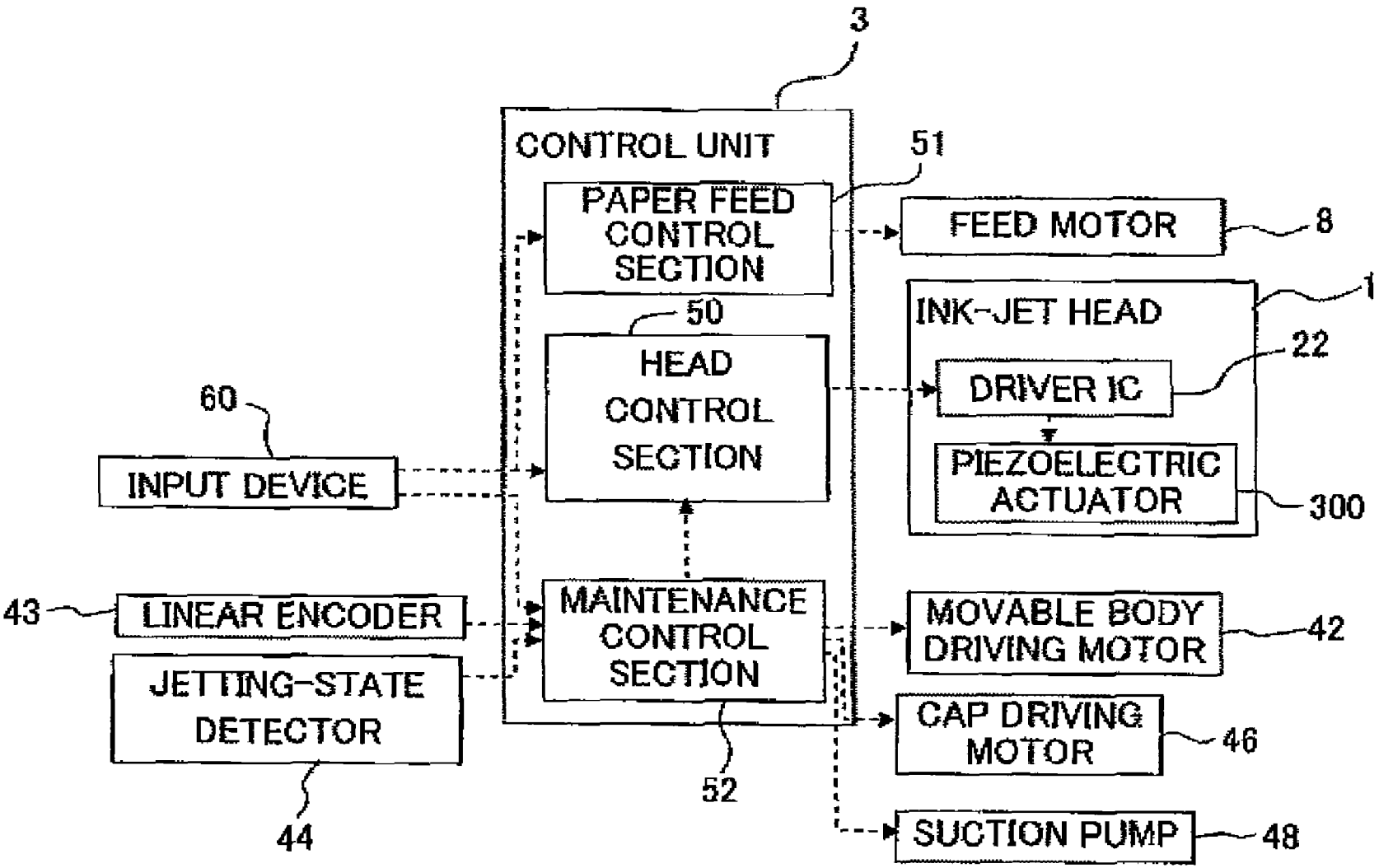
FIG. 9 is a block diagram showing an electrical construction of the ink-jet printer.
Figure 10:
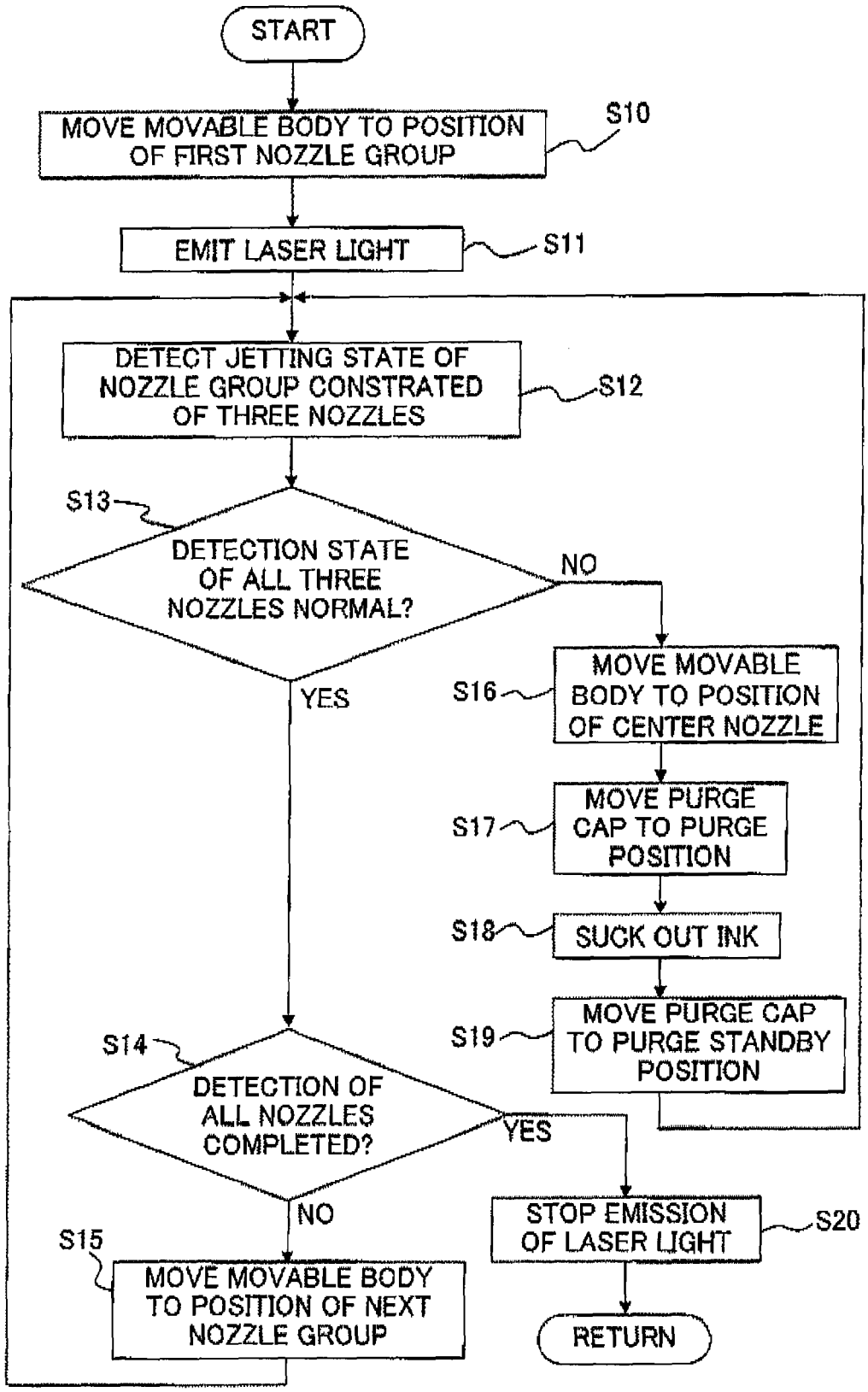
FIG. 10 is a flowchart of maintenance control.

First, an explanation will be given about an electrical construction of the control unit 3, with reference to a block diagram in FIG. 9. The control unit 3 is constructed of a CPU which is a Central Processing Unit; a ROM (Read Only Memory) which stores a various kinds of programs and data, and the like for controlling entire operations of the ink-jet printer 100; and a RAM (Random Access Memory) which temporarily stores data and the like which are processed in the CPU; and the like.

This control unit 3 has a head control section 50 which controls the ink jetting operation of the ink-jet head 1 based on print data inputted from an input device 60 such as PC; and a paper feed control section 51 which controls the feeding operation for the recording paper 6 by the feed motor 8 based on the print data inputted from the input device 60. Further, the control unit 3 has a maintenance control section 52 which controls a series of maintenance operations including controlling the movable body driving motor 42 to move the movable body 40 based on position information of the movable body 40 inputted from the linear encoder 43, and controlling the cap driving motor 46 and the suction pump 48 to purge a nozzle 20 in which jetting abnormality is detected by the jetting state detector 44. Note that each of the head control section 50, paper feed control section 51, and maintenance control section 52 is constituted of a CPU; a ROM; a RAM; a bus connecting the CPU, ROM and RAM; and the like.

Next, the maintenance control performed mainly by the maintenance control section 52 is explained in detail with reference to the flowchart of FIG. 10 and FIG. 11 to FIG. 14. Note that reference "Si" (i=10, 11, 12 . . . ) in the following explanation shows respective steps of the flowchart of FIG. 10. In the maintenance operation of the ink-jet head 100 of this embodiment, detection of jetting state is performed on each group of nozzles 20 constructed of three nozzles 20 which the purge cap 45 can cover at a time, and when at least one of the three nozzles 20 in each nozzle group is detected to be in an abnormal jetting state, the three nozzles 20 in this nozzle group are purged simultaneously.

Figure 11A:
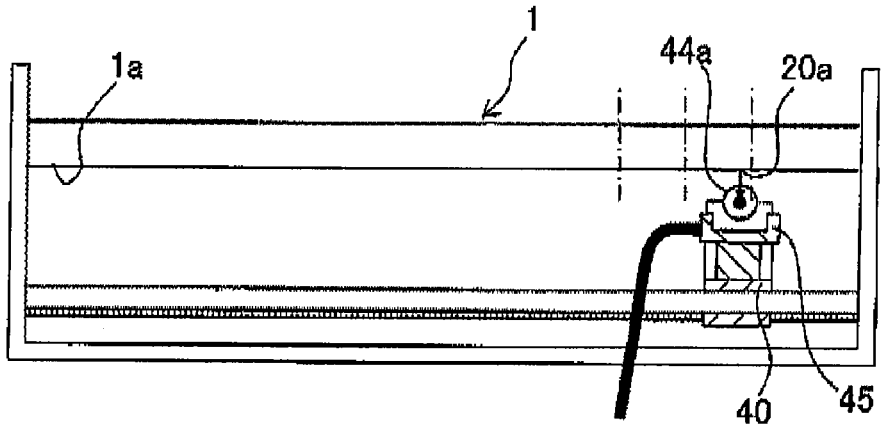
FIG. 11A is an explanatory view of a jetting state detection operation for a right-end nozzle of a first nozzle group.

This maintenance control is executed by inputting of the maintenance instruction from the input device 60 such as PC to the maintenance control section 52 when, for example, a printing defect such as generation of a white line or streak is confirmed visually by a user. First, the movable body driving motor 42 is controlled to move the movable body 40, which is located at the standby position, at one side in the scanning direction (right side in FIG. 11) relative to the feeding passage of the recording paper 6, to a position immediately below a right-end nozzle 20*a* belonging to a first (located at a right-most position) nozzle group as shown in FIG. 11A (S10); and then laser light is emitted forward from the light-emitting element 44*a* (S11). Then, ink is jetted respectively from the three nozzles 20 (20*a* to 20*c*) of this first nozzle group to detect jetting states of these three nozzles 20*a* to 20*c* respectively (S12).

Figure 11B:
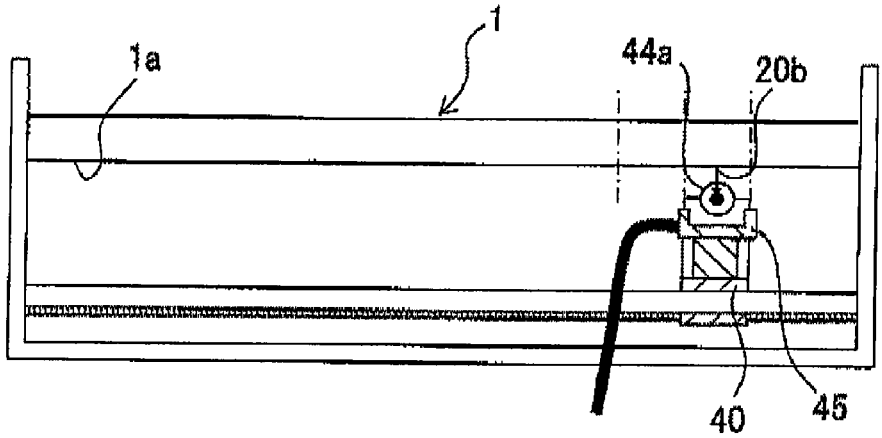
FIG. 11B is an explanatory view of a jetting state detection operation for a center nozzle of the first nozzle group.
Figure 11C:
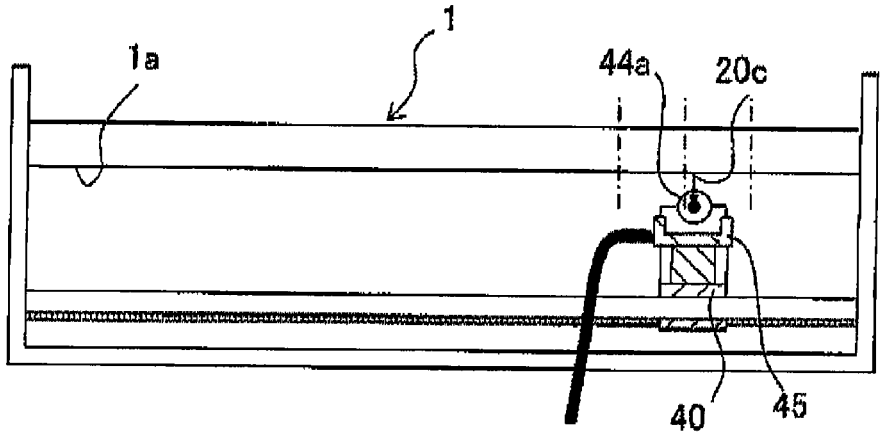
FIG. 11C is an explanatory view of a jetting state detection operation for a left-end nozzle of the first nozzle group.

Specifically, in a state that the movable body 40 is located immediately below the right-end nozzle 20, first, the head control section 50 receiving an instruction from the maintenance control section 52 controls the driver IC 22 to jet the ink from the nozzle 20*a*. Here, as shown in FIG. 11A, a liquid droplet of the ink is jetted from this nozzle 20*a* normally and vertically downward along the axis of the nozzle 20*a*. In this case, the laser light emitted from the light-emitting element 44*a* is momentarily blocked by the liquid droplet and does not reach the light-receiving element 44*b*, and thus it is detected that the jetting state of the nozzle 20*a* is normal. Note that at this time the purge cap 45 is at the purge standby position apart (away) from the liquid droplet jetting surface 1*a*, and thus the laser light will not be interfered by the purge cap 45. Further, the liquid droplet jetted from the nozzles 20 is received by the purge cap 45 at the purge standby position. Next, when the movable body 40 is moved by the movable body driving motor 42 leftward by the pitch P to be positioned immediately below the center nozzle 20*b* and a liquid droplet of the ink is jetted from the nozzle 20*b*, the liquid droplet of the ink is jetted vertically downward also from this nozzle 20*b* as shown in FIG. 11B, and thus it is detected by the jetting state detector 44 that the jetting state is normal also in the nozzle 20*b*. Moreover, when the movable body 40 is moved by the movable body driving motor 42 further leftward by the pitch P to be positioned immediately below the left-end nozzle 20*c* and a liquid droplet of the ink is jetted from the nozzle 20*c*, the liquid droplet of the ink is jetted vertically downward also from this nozzle 20*c* as shown in FIG. 11C, and thus it is detected by the jetting state detector 44 that the jetting state is normal also in the nozzle 20*c*.

In this manner, when the jetting states of the three nozzles 20*a* to 20*c* of this nozzle group are all detected to be normal, (S13: Yes), it is not necessary to purge these nozzles, and since the jetting state detection of all the nozzles 20 is not completed (S14: No), the movable body 40 is moved to the position of a right-end nozzle 20*d* belonging to the next nozzle group (S15).

Figure 12A:
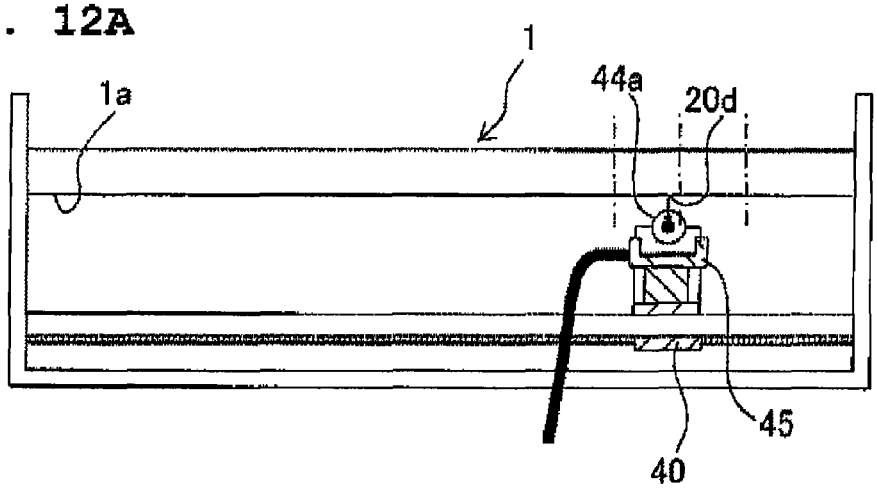
FIG. 12A is an explanatory view of a jetting state detection operation for a right-end nozzle of a second nozzle group.
Figure 12B:
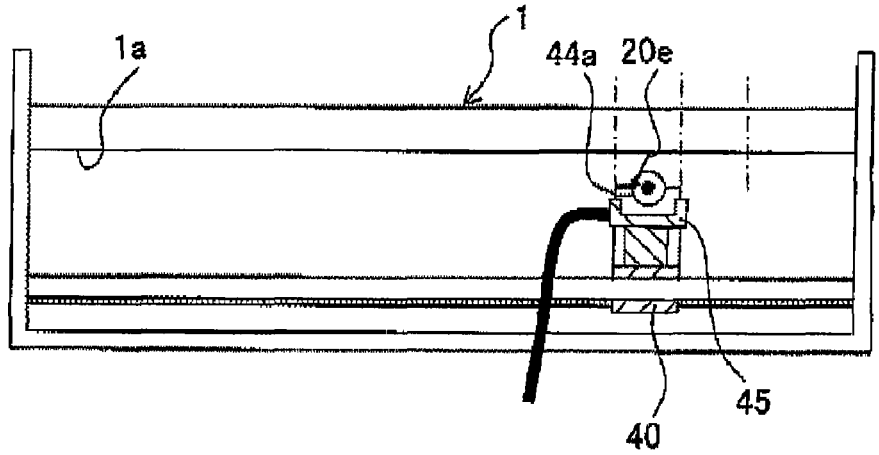
FIG. 12B is an explanatory view of a jetting state detection operation for a center nozzle of the second nozzle group.
Figure 12C:
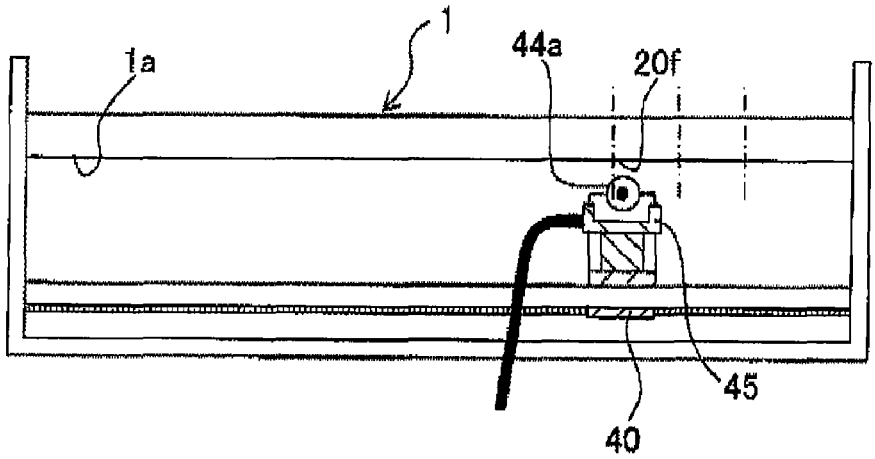
FIG. 12C is an explanatory view of a jetting state detection operation for a left-end nozzle of the second nozzle group.

Next, as shown in FIG. 12A to FIG. 12C, similarly to the above-described case of the first nozzle group, the jetting state detector 44 detects jetting states of three nozzles 20 (20*d* to 20*f*) of a second nozzle group respectively (S12). Here, as shown in FIG. 12A, a liquid droplet of the ink is jetted vertically downward from the right-end nozzle 20*d*, and the jetting state of this nozzle 20*d* is detected to be normal. However, as shown in FIG. 12B, from the center nozzle 20*e*, a liquid droplet of the ink is jetted in a direction bending (slanting) leftward relative to the vertical direction. In this case, the laser light emitted from the light-emitting element 44*a* is not blocked by the liquid droplet and continuously received by the light-receiving element 44*b* constantly, and thus the jetting state of the nozzle 20*e* is detected to be abnormal. Further, as shown in FIG. 12C, the left end nozzle 20*f* is in a state that any liquid droplet of the ink is not jetted (state of non-jetting or non-discharge). Also in this case, the laser light emitted from the light-emitting element 44*a* is not blocked by the liquid droplet, and thus the jetting state of the nozzle 20*f* is detected to be abnormal.

Figure 13:
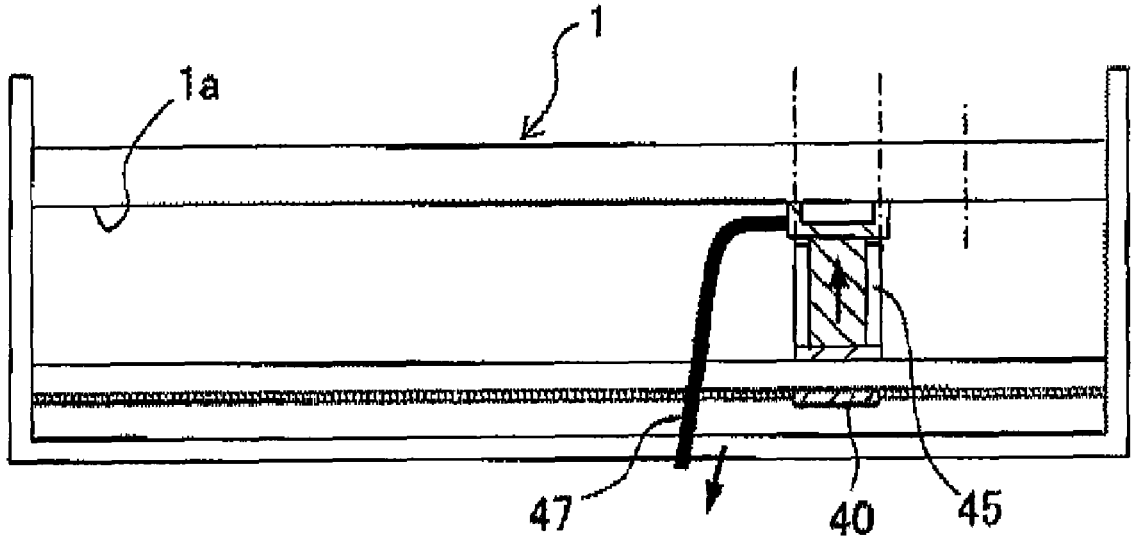
FIG. 13 is an explanatory view of nozzle purging.

In this manner, when a jetting state of any one of the three nozzles 20*d* to 20*f* is detected to be abnormal (S13: No), the nozzles are purged as follows. First, as shown in FIG. 13, the movable body 40 is moved by the movable body driving motor 42 to the position immediately below the center nozzle 20*e* (S16), and then the purge cap 45 is driven upward by the cap driving motor 46 to be moved to the purge position at which the purge cap 45 covers only jetting ports 25 of the three nozzles 20*d* to 20*f* on the liquid droplet jetting surface 1*a* and at which the purge cap 45 contacts the liquid droplet jetting surface 1*a* (S17). In this state, the inside of the purge cap 45 is sucked and decompressed by the suction pump 48 connected to the purge cap 45 via the tube 47, thereby forcibly discharging the ink from the respective jetting ports 25 of the three nozzles 20*d* to 20*f* into the purge cap 45 (S18). Thereafter, the purge cap 45 is driven downward by the cap driving motor 46 and returned to the purge standby position (S19).

Note that as shown in FIG. 8, the width W of the purge cap 45 is three times the pitch P between the nozzles 20 (W=3P). Accordingly, when the purge cap 45 is at the purge standby position, edges of the purge cap 45 will not overlap and interfere with the jetting ports 25 of two nozzles 20 which are adjacent to both sides, respectively, of the three nozzles 20*d* to 20*f* covered by the purge cap 45. Therefore, by this purging, there occurs no adverse effect such as causing jetting abnormality by entrance of air into two adjacent normal nozzles 20.

Figure 14A:
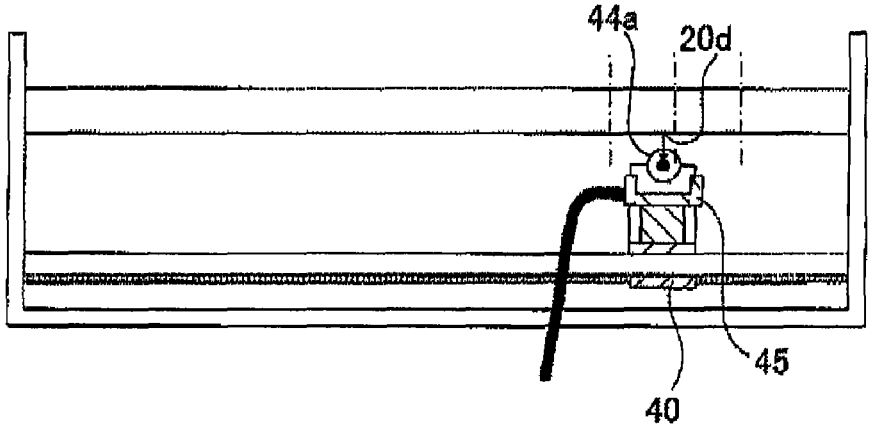
FIG. 14A is an explanatory view of a jetting state re-detection operation for the right-end nozzle of the second nozzle group.
Figure 14B:
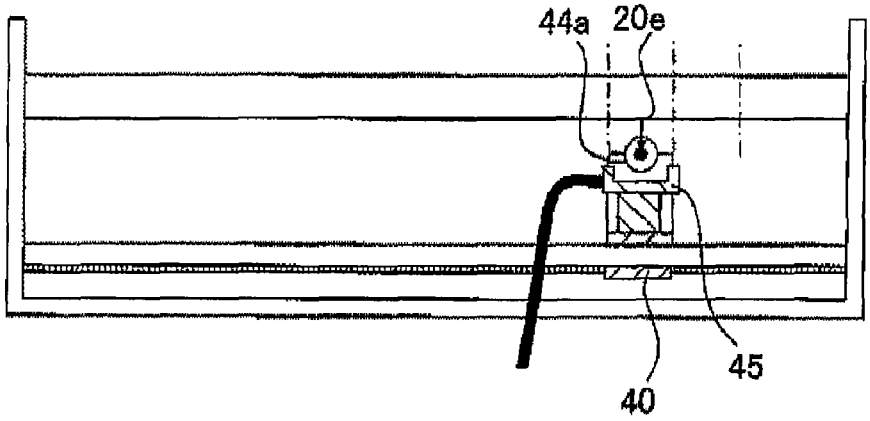
FIG. 14B is an explanatory view of a jetting state re-detection operation for the center nozzle of the second nozzle group.
Figure 14C:
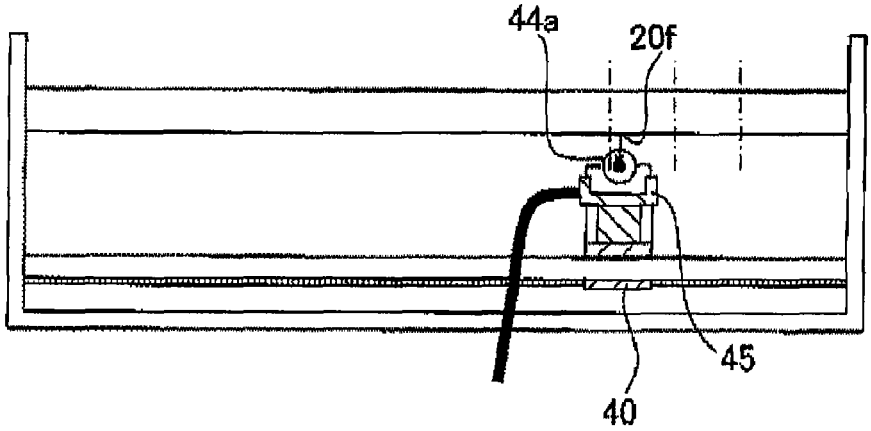
FIG. 14C is an explanatory view of a jetting state re-detection operation for the left-end nozzle of the second nozzle group.

Furthermore, after the ink is discharged by the suction pump 48 forcibly from the three nozzles 20*d* to 20*f* covered by the purge cap 45, as shown in FIG. 14A to FIG. 14C, jetting states of liquid droplets in these three nozzles 20*d* to 20*f* are detected again by the jetting state detector 44 (S12). In this manner, after the nozzles 20 (20*e*, 20*f*) in an abnormal jetting state are purged, it is possible to confirm whether or not these nozzles 20 (20*e*, 20*f*) are recovered from the jetting abnormality.

Then, when it is confirmed that the jetting abnormality of the nozzles 20 is recovered by the nozzle purging (S13: Yes), the movable body 40 is moved leftward to proceed to detection of jetting abnormality in the next nozzle group. The above series of operations is performed repeatedly, and when it is detected that jetting states are normal in all the nozzles 20 (S14: Yes), the emission of laser light from the light-emitting element 44*a* is stopped (S20) to complete the maintenance control and the operations are returned.

According to the ink-jet printer 100 of the above-described embodiment, following effects can be obtained.

Since jetting states of all the nozzles 20 can be detected by moving the jetting state detector 44 integrally with the movable body 40 in the scanning direction (arrangement direction of the nozzles 20), a nozzle 20, among the nozzles 20, which has jetting abnormality can be identified. Further, the structure is simpler as compared to the case that the jetting state detection section is provided for each of all the nozzles 20, and also the number of parts decreases, so that the manufacturing costs of the ink-jet printer 100 can be lowered.

Further, the purge cap 45 moves integrally with the movable body 40 in the scanning direction, and moreover, when the purge cap 45 moves from the purge standby position to the purge position, the purge cap 45 covers only the vicinity of the jetting ports of three nozzles 20 including a nozzle 20 having jetting abnormality. Therefore, only these three nozzles 20 can be purged, and other nozzles 20 are not purged. Further, when the three nozzles 20 are purged, the ink discharged from these nozzles 20 will not adhere to the vicinity of the jetting port 25 of another nozzle 20 which is other than these three nozzles 20 and is not covered by the purge cap 45, and therefore jetting abnormality in another nozzle 20, which would be otherwise caused by nozzle purging, can be prevented as much as possible.

From the light-emitting element 44*a* of the jetting state detector 44, light is emitted orthogonal to the scanning direction (arrangement direction of the nozzles 20). In this way, whether or not there is generated bending of a jetting direction (displacement or deviation from the landing position) in the scanning direction in a nozzle 20, which adversely affects printing quality, can be detected simply and securely by whether or not the light from the light-emitting element 44*a* is momentarily blocked by a liquid droplet.

Next, an explanation will be given about modifications in each of which various changes are made to the embodiment. Parts or components of the modification, which are same in construction as those in the embodiment, will be assigned with same reference numerals and any explanation therefor will be omitted as appropriate.

1First Modification

Figure 15:
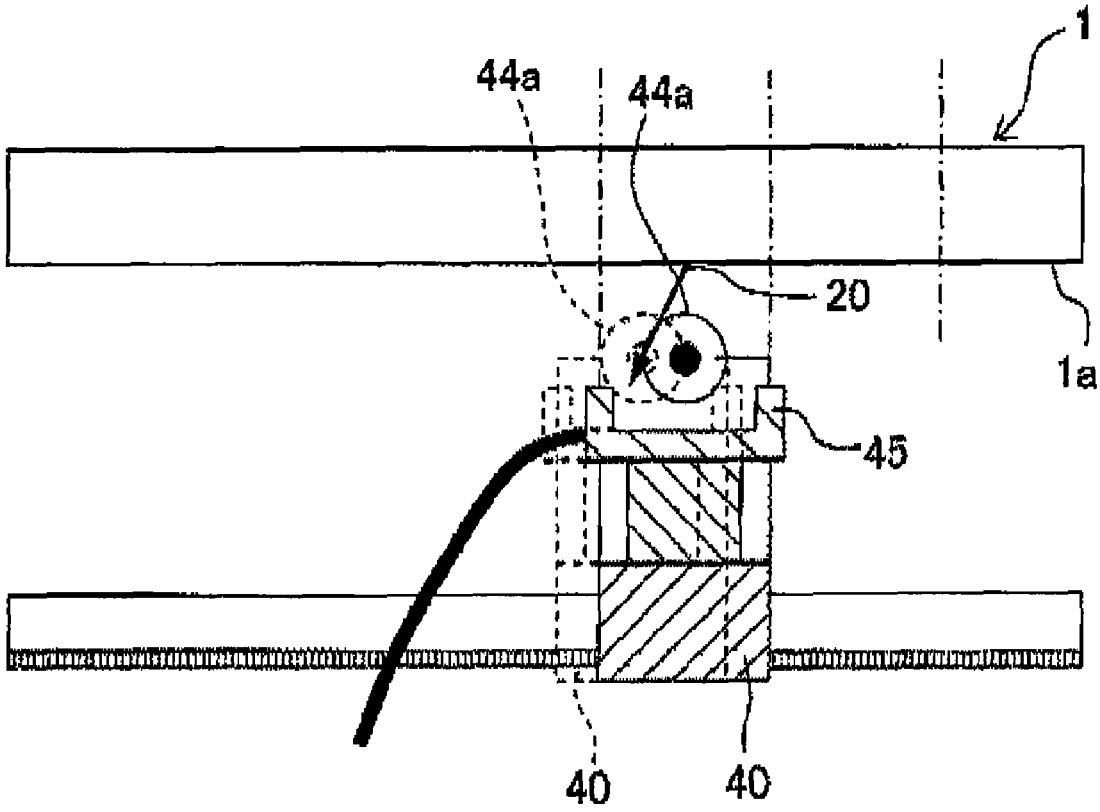
FIG. 15 is an explanatory view showing a detection operation of a jetting state for a nozzle in a modification of the embodiment.

The ink-jet printer 100 of the above embodiment stops the movable body 40 once at a position immediately below each of the nozzles 20, and in this state the ink is jetted from the nozzle 20 to detect a jetting state of the nozzle 20 (see FIG. 12). Instead, as shown in FIG. 15, while moving the movable body 40 continuously, the ink may be jetted from a nozzle 20 at timing when the movable body 40 reaches a position immediately below this nozzle 20. When the jetting state of the nozzle 20 is normal, a jetted liquid droplet momentarily blocks the laser light emitted from the light-emitting element 44*a* when the movable body 40 reaches a position substantially immediately below the nozzle 20 as shown by the solid line in FIG. 15. On the other hand, as shown in FIG. 15, when the jetting direction of liquid droplets jetted from the nozzle 20 is bent leftward relative to the vertical direction, the liquid droplet jetted from the nozzle 20 momentarily blocks the laser light emitted from the light-emitting element 44*a* when the movable body 40 passes the position immediately below the nozzle 20 and further moves leftward as shown by dashed lines in FIG. 15. Therefore, when a displacement amount of the position of the movable body 40, when the laser light is blocked, relative to the position immediately below the nozzle 20 surpasses a predetermined tolerable or permissible displacement amount, the jetting state of the nozzle 20 is detected to be abnormal.

2Second Modification

The ink-jet printer 100 of the above embodiment is constructed such that a jetting state is detected for every nozzle group each formed of three nozzles 20 which the purge cap 45 can cover at a time, and when a jetting state of at least one of three nozzles 20 in each nozzle group is detected to be abnormal, the three nozzles 20 are purged simultaneously (see FIG. 13 and FIG. 14). On the other hand, as shown in FIG. 16, the following construction may also be adopted such that when a jetting state of a certain nozzle 20 is detected to be abnormal, the purge cap 45 is moved immediately to the purge position to cover the jetting port 25 of the nozzle 20 having jetting abnormality to purge the nozzle 20 instantly.

Figure 16A:
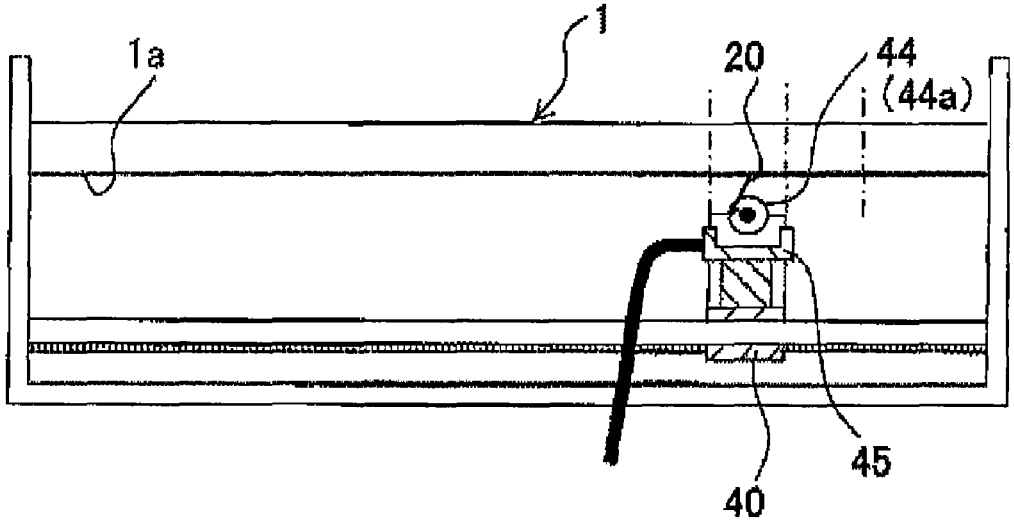
FIG. 16A is an explanatory view of a detection operation of a jetting state of a nozzle in another modification of the embodiment.
Figure 16B:
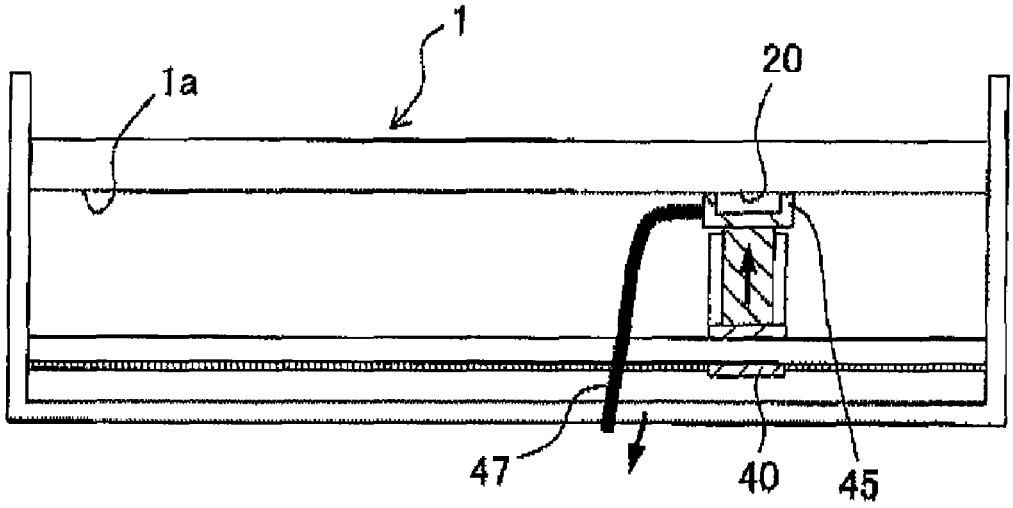
FIG. 16B is an explanatory view of nozzle purging in the another modification.

Also in this modified embodiment, as shown in FIG. 16A, a liquid droplet of the ink is jetted from the nozzle 20 in a state that the movable body 40 is positioned immediately below the nozzle 20, and a jetting state of the nozzle 20 is detected by the jetting state detector 44 by whether or not the liquid droplet momentarily blocks the laser light. At this time, the purge cap 45 is at a purge standby position apart and away from the liquid droplet jetting surface 1*a*. Here, when the jetting state is detected to be abnormal, the purge cap 45 at the purge standby position is driven upward immediately by the cap driving motor 46 (see FIG. 9) as shown in FIG. 16B and moved to the purge position at which the purge cap 45 covers the vicinity of the jetting port 25 of the nozzle 20 having jetting abnormality on the liquid droplet jetting surface 1*a*. In other words, while the jetting state detector 44 is detecting a jetting state of a certain nozzle 20, the movable body 40 is at a position such that the purge cap 45 can cover the jetting port 25 of the nozzle 20 by just being moved from the purge standby position to the purge position thereabove. With this construction, when abnormality of a jetting state of a certain nozzle 20 is detected, the jetting port of this nozzle 20 can be covered by the purge cap 45 and purged instantly, by just moving the purge cap 45 to the purge position without moving the movable body 40 in the scanning direction. Therefore, the time needed for the entire maintenance operation including the detecting operation of jetting abnormality of the nozzle 20 and the recovery operation thereof becomes short.

On the contrary to the above, the following construction may also be adopted such that after jetting states of all the nozzles 20 are detected by the jetting state detector 44, the movable body 40 is moved anew to a position immediately below the nozzle 20 detected to be in an abnormal jetting state to purge this nozzle 20 having jetting abnormality.

3Third Modification

Figure 17:
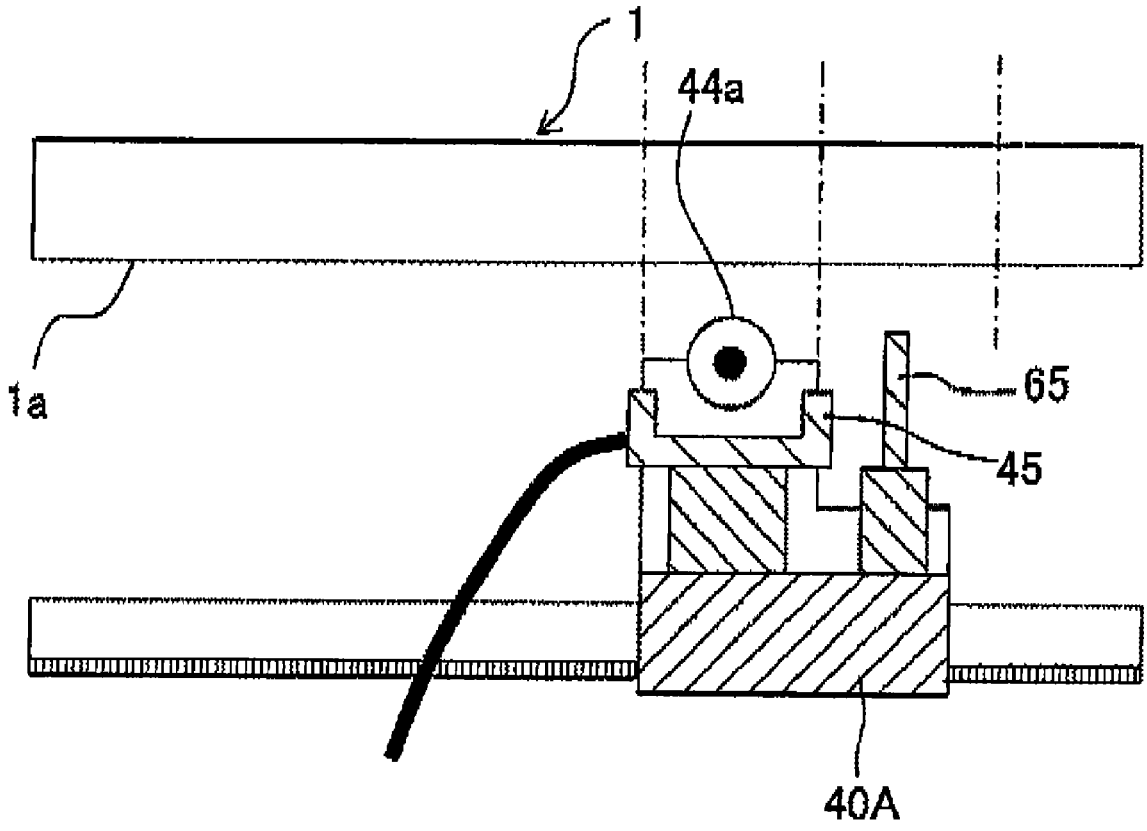
FIG. 17 is an enlarged view of the vicinity of a movable body of a still another modification of the embodiment.

The movable body may be provided with a wiper which wipes the ink adhered to the liquid droplet jetting surface after nozzle purging. For example, as shown in FIG. 17, a wiper 65 extending vertically is provided on a movable body 40A at a right side of a purge cap 45 (on a side opposite to a moving direction) of the movable body 40A when a jetting state is detected). This wiper 65 is constituted of a material having flexibility such as a rubber material, and is driven vertically by a driving mechanism provided on the movable body 40A. Then, after a certain nozzle 20 among the nozzles 20 is purged, in a state that the wiper 65 is driven upward and the tip thereof contacts the liquid droplet jetting surface 1*a*, the movable body 40A is moved leftward so that the ink which adhered to the vicinity of the jetting port 25 of the nozzle 20 during nozzle purging is wiped by the wiper 65. With this construction, the wiper 65 moves in a left and right direction (scanning direction) integrally with the movable body 40A. Accordingly, there is no need for a structure to move the wiper 65 relative to the liquid droplet jetting surface 1*a* for wiping ink.

4Fourth Modification

The number of jetting ports 25 of nozzles 20 to be covered at a time by the purge cap 45 which is at the purge position is not limited to three as in the above embodiment. However, in the case where the number of jetting ports to be covered at a time is large, when purging a nozzle 20 having jetting abnormality, then the number of nozzles 20 in a normal jetting state to be covered together with this nozzle 20 at the same time increases, which in turn raises the percentage that jetting abnormality occurs in these normal nozzles 20 due to the adhesion of discharged ink to the vicinity of the jetting ports 25 of these normal nozzles 20. In this aspect, it is preferable that the number of jetting ports 25 to be covered at a time by the purge cap 45 is as small as possible, and it is most preferable that the purge cap 45 covers only one jetting port 25.

5Fifth Modification

Although the ink-jet printer 100 in the above embodiment is constructed such that, when any one of the nozzles 20 of the line-type ink-jet head 1 is in an abnormal jetting state, this nozzle 20 is purged, the following construction may also be adopted that the ink is jetted from a nozzle of an auxiliary head other than the ink-jet head 1, in place of the nozzle 20 having jetting abnormality.

Figure 18:
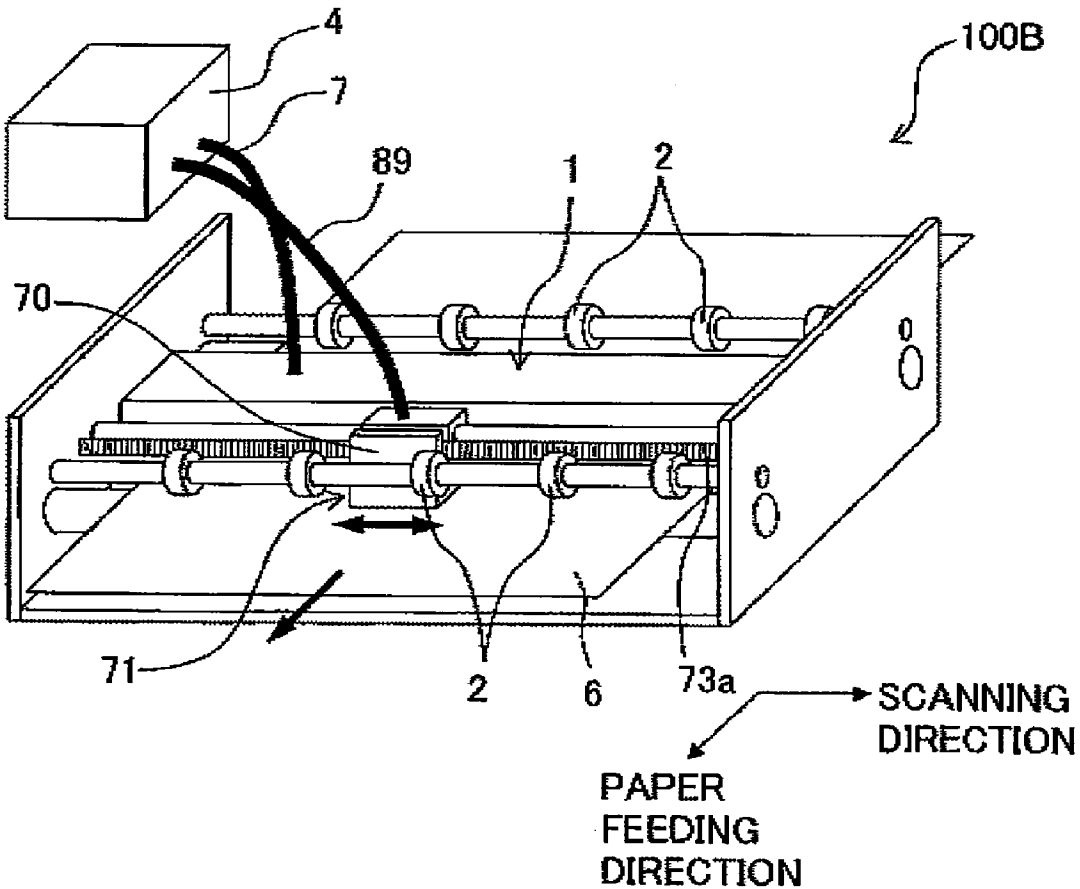
FIG. 18 is a perspective view showing a schematic structure of an ink-jet printer according to a yet another modification of the embodiment.

As shown in FIG. 18, an ink-jet printer 100B of this modification has an ink-jet head 1 which is a line-type head and which extends in a width direction of recording paper 6 (scanning direction; left and right direction in FIG. 18); feeding rollers 2 which feed or transport the recording paper 6 in a forward direction in FIG. 18; a control unit 3B (see FIG. 20) which controls the entire operation of the ink-jet printer 100B; and the like. The ink-jet printer 100B is constructed such that an ink is jetted from nozzles 20 (first nozzles: see FIGS. 2 to 5) onto a recording paper 6, and the recording paper 6, on which the letter and/or image has been recorded by the ink-jet head 1, is discharged in the forward direction (paper feeding direction) by the feeding roller 2. Further, similarly to the above-described embodiment, a movable body 40 (see FIG. 6) movable in the scanning direction is provided under the ink-jet head 1, and furthermore, a jetting state detector 44 having a light-emitting element 44*a* and a light-receiving element 44*b* (see FIG. 6) are provided on an upper portion of the movable body 40.

Moreover, the ink-jet printer 100B has a carriage 70 movable in the scanning direction in front of the ink-jet head 1, and an auxiliary head 71 (second liquid-droplet jetting head) provided on this carriage 70. The carriage 70 and the auxiliary head 71 are driven in the scanning direction by a head driving motor 72 (head drive mechanism: see FIG. 20). Further, the ink-jet printer 100B also is provided with a scale 73*a*, and a linear encoder 73 (head position detector: see FIG. 20) which detects a position of the auxiliary head 71 in the scanning direction is provided. The scale 73*a* is arranged parallel to the scanning direction.

Figure 19:
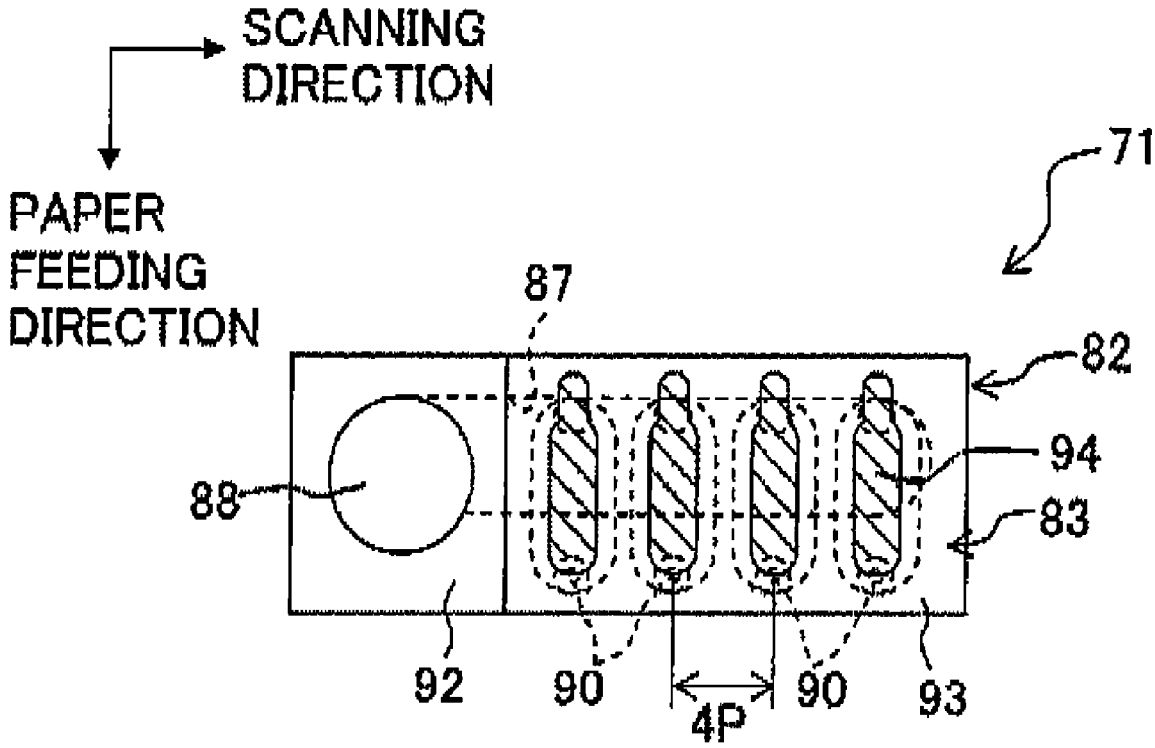
FIG. 19 is a plan view of an auxiliary head.

As shown in FIG. 19, the auxiliary head 71 has a similar structure as the line-type ink-jet head 1, except for the numbers of pressure chambers and nozzles. Specifically, the auxiliary head 71 has a channel unit 82 in which an ink channel including pressure chambers 84 and nozzles 90 are formed; and a piezoelectric actuator 83 arranged on an upper surface of this channel unit 82. In the channel unit 82, four pressure chambers 84, four nozzles 90 (second nozzles), and a manifold 87 are formed. The four pressure chambers 84 have a substantially elliptic form in a plan view and are arranged in one array (row) in the scanning direction. The four nozzles 90 communicate with the four pressure chambers 84, respectively, and are also arranged in an array (row) in the scanning direction. The manifold 87 extends in the scanning direction and communicates with the four pressure chambers 84. The pressure chambers 84 and the nozzles 90 are formed to have same shape and size as those of the pressure chambers 14 and the nozzles 20 (see FIGS. 2 and 3), respectively, of the ink-jet head 1. Further, a pitch at which the nozzles 90 are arranged is same as a pitch (four times of "P" in FIG. 2) at which the nozzles 20 each belonging to one of the four nozzle rows in the ink-jet head 1 are arranged. As shown in FIGS. 18 and 19, the manifold 87 is connected to the ink tank 4 via a tube 59 and an ink supply hole 88 which is formed in a vibration plate 92, of the piezoelectric actuator 83, covering the four pressure chambers 84. Furthermore, four individual ink channels, each of which from the manifold 87 to one of the nozzles 90 via one of the pressure chambers 84, axe formed in the channel unit 82 in substantially same shape and a substantially same size as those of the individual ink channels 21 (see FIG. 4) in the ink-jet head 1.

Further, the piezoelectric actuator 83 has substantially the same structure as the piezoelectric actuator 300 (see FIG. 2 to FIG. 5) of the ink-jet head 1. Namely, the piezoelectric actuator 83 has the vibration plate 92 covering the four pressure chambers 84; a piezoelectric layer 93 formed on the upper surface of the vibration plate 92; and four individual electrodes 94 formed on the upper surface of the piezoelectric layer 93 to correspond to the four pressure chambers 84, respectively. Each of the individual electrodes 94 is formed to have same shape and size as those for each of the individual electrodes 32 in the ink-jet head 1, and is arranged to face the central portion of one of the pressure chambers 84 to which the individual electrode 94 corresponds. Further, the four individual electrodes 94 are constructed to be selectively applied with a drive voltage from a driver IC 95 (see FIG. 20).

Figure 20:
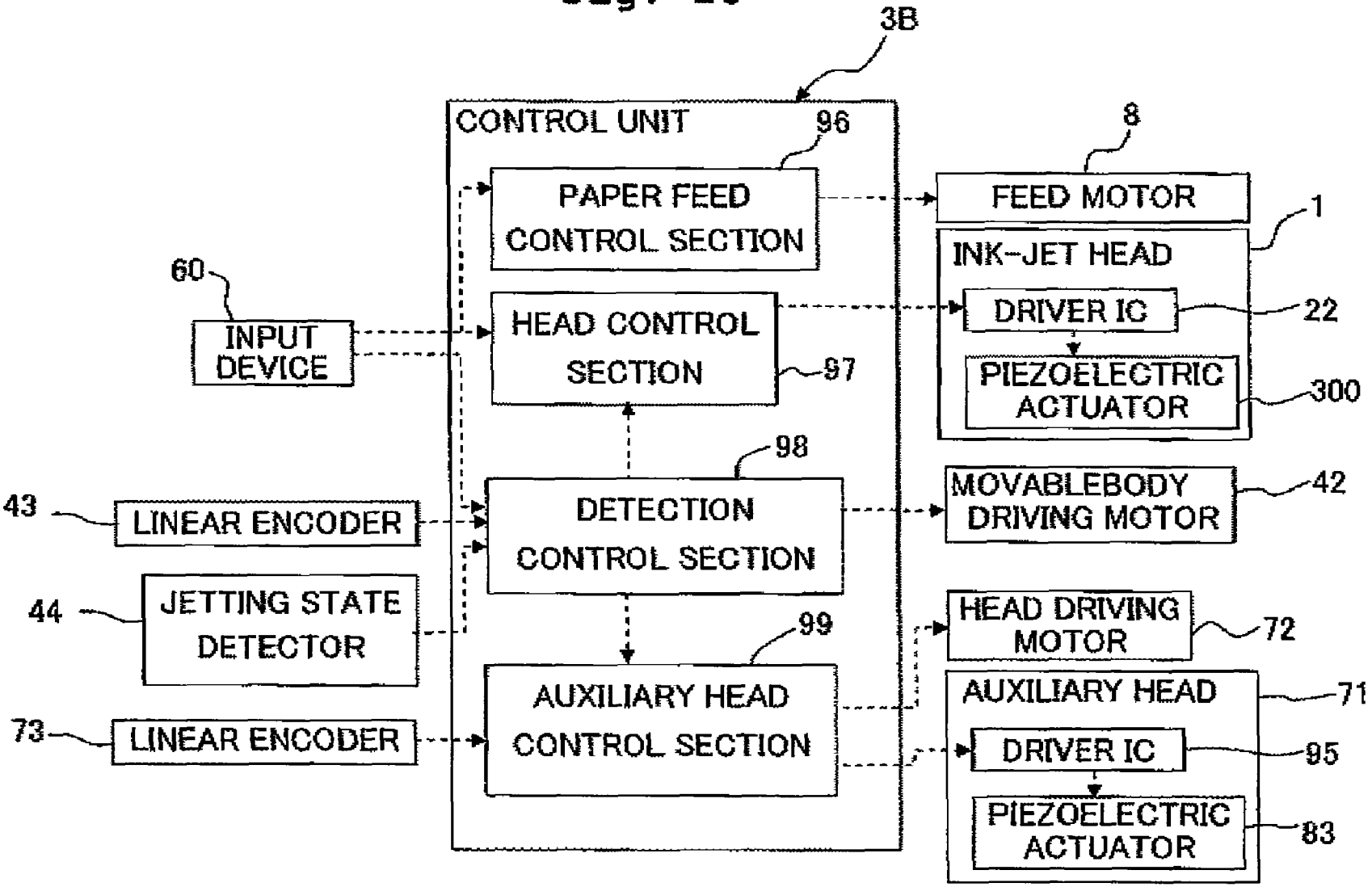
FIG. 20 is a block diagram showing an electrical construction of the ink-jet printer of FIG. 18.

As shown in FIG. 20, the control unit 3B has a head control section 97 which controls the ink-jetting operation of the ink-jet head 1, based on a print data inputted from a input device 60 such as PC; a paper feed control section 96 which controls, based on the print date, the feed motor 8 which rotates and drives the feeding rollers 2; a detection control section 98 which controls a series of operations including controlling the movable body driving motor 42 so as to move the movable body 40, based on a position information of the movable body 40 inputted from the linear encoder 43, and detecting the jetting state for each of the plurality of nozzles 20 by the jetting state detector 44; an auxiliary head control section 99 which controls the auxiliary head 71; and the like. Each of the head control section 97, paper feed control section 96, detection control section 98, and auxiliary head control section 99 is constructed of a CPU; a ROM; a RAM; a bass connecting the CPU, the ROM and the RAM; and the like.

Then, when a jetting state of a certain nozzle 20, among the nozzles 20, of the ink-jet head 1 is detected to be abnormal by the jetting state detector 44, the detection control section 98 transmits, to the head control section 97, an instruction not to jet the ink from the certain nozzle 20, and transmits to the auxiliary head control section 99 an instruction to jet the ink from any of the nozzles 90 of the auxiliary head 71 instead of the certain nozzle 20 having jetting abnormality. Then, the auxiliary head control section 99 controls the head driving motor 72 based on position information of the auxiliary head 71 inputted from the linear encoder 73 to move the auxiliary head 71 so that one of the nozzles 90 of the auxiliary head 71 is located at a position which is same as the position, with respect to the scanning direction, of the abnormal nozzle 20 (the nozzle having the jetting abnormality) in the ink-jet head 1. Further, the auxiliary head control section 99 controls the driver IC 95 so as to jet a liquid droplet of ink from the nozzle 90 among the nozzles 90. In this manner, in a case that a certain nozzle 20 of the ink-jet head 1 is in an abnormal jetting state, the nozzle 20 having jetting abnormality is identified so that the abnormal nozzle 20 can be complemented (substituted) by the nozzles 90 of the auxiliary head 71 by identifying the nozzle 20, thereby making it possible to prevent the deterioration in printing quality.

It is not necessarily indispensable that the nozzles 90 of the auxiliary head 71 are a plurality of nozzles. However, when the nozzles 90 are provided as a plurality of nozzles, it is easy to perform complement or substitution by the nozzles 90 of the auxiliary head 71 when jetting states of two or more nozzles 20 of the ink-jet head 1 become abnormal at the same time. Namely, as shown in FIG. 19, when the auxiliary head 71 has the plurality of the nozzles 90 arranged in the scanning direction with a pitch (=4P) equal to that by which the nozzles 20 are arranged in each of the nozzle rows in the ink-jet head 1, two or more nozzles 20 (at least two nozzles 20) of the ink-jet head 1 which are adjacent in the scanning direction can be complemented or substituted for at the same time without moving the auxiliary head 71 in the scanning direction.

6Sixth Modification

It is not necessarily indispensable that the laser light emitted from the light-emitting element 44*a* is orthogonal to the scanning direction (nozzle arrangement direction). When the laser beam crosses the scanning direction with an angle other than 90 degrees, it is also is possible to detect bending of the jetting direction in the scanning direction.

7Seventh Modification

In addition to the jetting state detector 44 capable of detecting the bending of the jetting direction in the scanning direction, a light-emitting element which emits laser light in the scanning direction and a light-receiving element which receives this light may be provided further on the ink-jet head 1 at both sides thereof in the scanning direction, respectively, so as to detect the bending of the jetting direction with respect to the paper feeding direction.

8Eighth Modification

The light-emitting element is not limited to one that emits laser light, and may be one that emits another kind of light such as visible light. Further, the jetting state detector is not limited to that of an optical type which has a light-emitting element and a light-receiving element, and various types of detection sections or detectors can be adopted. For example, the detector may be of a type which has an electrode provided on a surface facing the liquid droplet jetting surface of the movable body, and which recognizes, when a liquid droplet of a charged ink is jetted toward the electrode, a landing position of the liquid droplet, from the change in potential on surface of the electrode, thereby detecting the jetting state.

Figure 21A:
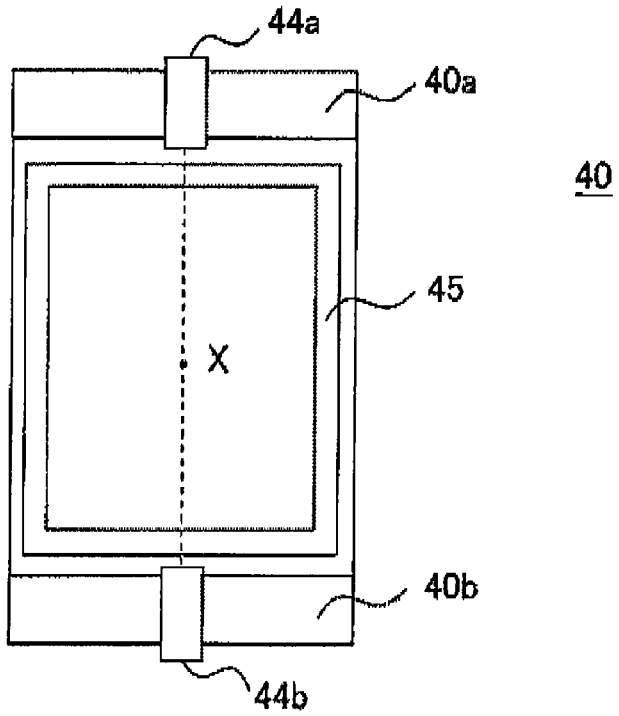
FIG. 21A is a plan view showing a movable body of the embodiment as viewed from a side of the liquid-droplet jetting surface of the ink-jet head.

FIG. 21A is a drawing showing a movable body 40 in the first embodiment, as viewed from a side of the liquid-droplet jetting surface 1*a* of the ink-jet head 1. In the first embodiment, when a liquid droplet jetted from a nozzle does not passes through laser beam emitted from the light emitting element 44*a* to the light receiving element 44*b*, it is detected that the jetting state of the nozzle is abnormal. Namely, when the liquid droplet jetted from the nozzle passes on a trajectory or light path (indicated by dashed line in FIG. 21A), the liquid droplet consequently blocks the laser beam, and thus the jetting state of the nozzle is detected to be normal in the jetting direction. More specifically, even when the liquid droplet blocks the laser beam at a position, which is offset, on the light path of the laser beam, from a desired position (in the vertical direction downward from the jetting port of the nozzle), such a offset cannot be detected by the detection system (detector) as shown in FIG. 21A. In the following, an explanation will be given about a modification for solving the problem.

9Ninth Modification

Figure 21B:
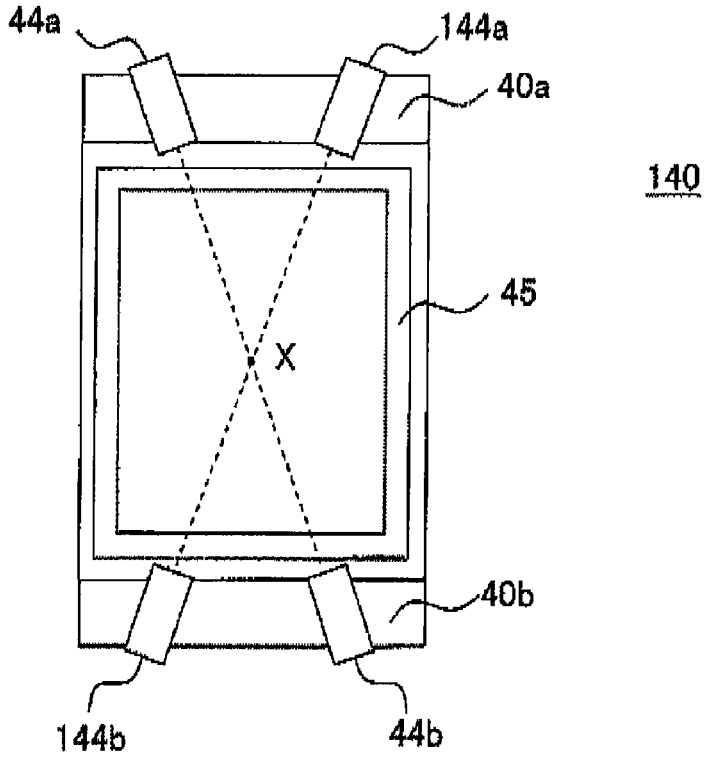
FIG. 21B is a plan view showing a movable body of a modification of the embodiment as viewed from a side of the liquid-droplet jetting surface of the ink-jet head.

A movable body 140 as shown in FIG. 21B has a first light-emitting element 44*a* and a second light-emitting element 144*a* which are attached to a wall 40*a* and a second light-receiving element 44*b* and a second light-receiving element 144*b* which are attached to a wall 40*b*. A first laser beam 151 emitted from the first light-emitting element 44*a* passes through a desired position X (vertically downward position from the jetting port of the nozzle), and then is received by the first light-receiving element 44*b*. A second laser beam 152 emitted from the second light-emitting element 144*a* passes through the desired position X, and then is received by the second light-receiving element 144*b*. The first light-emitting element 44*a* and the first light-receiving element 144*a* are arranged such that the light path of the first laser beam 151 is inclined with respect to the paper feeding direction; and the second light-emitting element 44*b* and the second light-receiving element 144*b* are arranged such that the light path of the second laser beam 152 is inclined with respect to the paper feeding direction and is intersected with the first laser beam 151 at the position X. According to such a construction, when it is detected that the light reception is blocked (interrupted) by the liquid droplet both at the first and second light-receiving elements 44*b* and 144*b*, it is appreciated that the liquid droplet is jetted onto the desired position X. Here, the first light-emitting element 44*a* and the first light-receiving element 44*b* may be arranged such that the light path of the first laser beam 151 is parallel to the paper feeding direction and passes thorough the position X. In this case, the second light-emitting element 144*a* and the second light-receiving element 144*b* may be arranged such that the light path of the second laser beam 152 is inclined with respect to the light path of the first laser beam 151 and is intersected with the first laser beam 151 at the position X.

10Tenth Modification

Figure 22A:
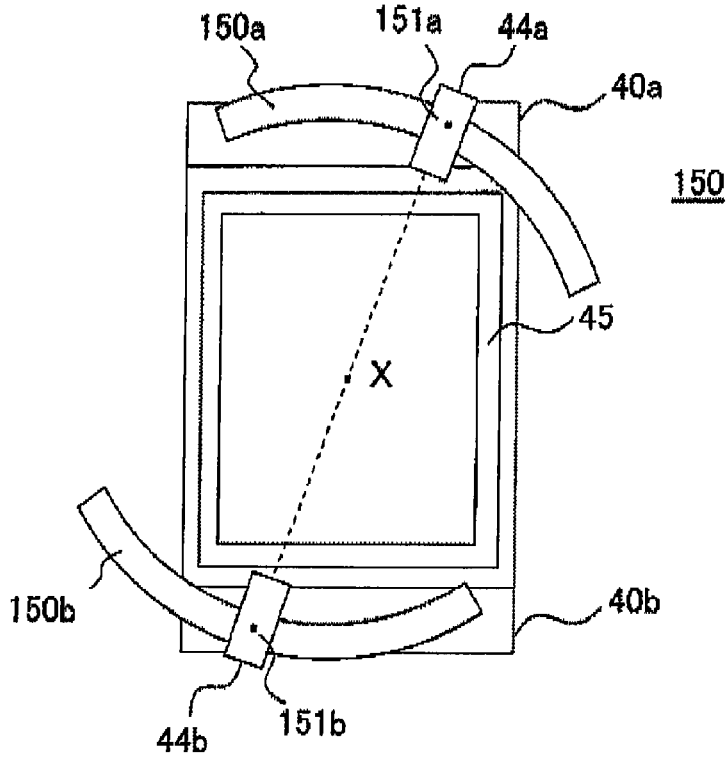
FIGS. 22A and 22B are a plan view showing a movable body of another modification of the embodiment as viewed from a side of the liquid-droplet jetting surface of the ink-jet head.
Figure 22B:
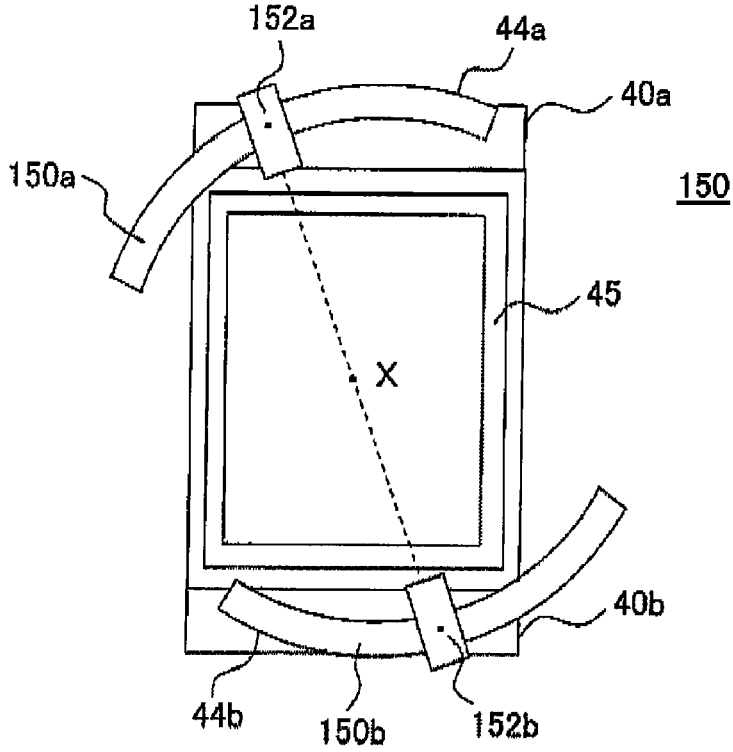

Further, a movable body 150 of another modification as shown in FIGS. 22A and 22B includes a first semicircular (arched) arm 150*a* pivotably (swingably) attached to a wall 40*a*; a second semicircular (arched) arm 150*b* pivotably attached to a wall 40*b*; a light emitting element 44*a* attached to the first semicircular arm 150*a*; a light receiving element 44*b* attached to the second semicircular arm 150*b*; and a drive motor (not shown) which is provided on a lower portion of the movable body 150 and which causes the first and second semicircular arms 150*a* and 150*b* pivot along the walls 40*a* and 40*b*, respectively. The first and second semicircular arms 44*a* and 44*b* are connected to each other by a supporting section (not shown) which extends in a radial direction of the semicircular arms. The supporting section is axially supported, by a spindle (not shown) of the drive motor, at the central portion in the longitudinal direction of the supporting section. When the first and second semicircular arms 44*a* and 44*b* are driven by the drive motor to pivot along the walls 40*a* and 40*b*, respectively, with a desired position X (vertically downward position from the jetting port of the nozzle) as the pivot center (pivot point), the light emitting element 44*a* can move between a first position (151*a*) as shown in FIG. 22A and a second position (152*a*) as shown in FIG. 22B and the light receiving element 44*b* can move between a first position (151*b*) as shown in FIG. 22A and a second position (152*b*) as shown in FIG. 22B. The light emitting element 44*a* and the light receiving element 44*b* are arranged on the first and second semicircular arms, respectively, such that the laser beam, which is emitted from the light emitting element 44*a* at the first position (11*a*), passes through the desired position X and then is received by the light receiving element 44*b* at the first position (151*b*); and that the laser beam, which is emitted from the light emitting element 44*a* at the second position (152*a*), passes through the desired position X and then is received by the light receiving element 44*b* at the second position (152*b*). First, the first and second semicircular arms are pivoted such that the light emitting element 44*a* and the light receiving element 44*b* are arranged at the first positions (151*a*, 151*b*), respectively, and it is detected at the light receiving element 44*b* whether or not the laser beam emitted from the light emitting element 44*a* is blocked by a liquid droplet jetted from the nozzle. When it is detected that the laser beam is blocked by the liquid droplet, it is appreciated that the liquid droplet is jetted on the light path of the laser beam between the first positions (151*a*, 151*b*). Next, the first and second semicircular arms are pivoted such that the light emitting element 44*a* and the light receiving element 44*b* are arranged at the second positions (152*a*, 152*b*), respectively, and it is detected at the light receiving element 44*b* whether or not the laser beam emitted from the light emitting element 44*a* is blocked by a liquid droplet jetted from the nozzle. When it is detected that the laser beam is blocked by the liquid droplet, it is appreciated that the liquid droplet is jetted on the light path of the laser beam at the second positions (152*a*, 152*b*). According to such a construction, when it is detected that the laser beam is blocked with the light receiving element 44*b* at both the first and second positions (151*b*, 152*b*), it is appreciated that the liquid droplet is jetted onto the desired position X. It should be noted that the light emitting element 44*a* and the light receiving element 44*b* need not be moved (pivoted) between the first and second positions, respectively, every time that each of the nozzles is inspected. For example, all the nozzles may be inspected in a state that the light emitting element 44*a* and the light receiving element 44*b* are arranged at the first positions (151*a*, 151*b*), respectively; then the light emitting element 44*a* and the light receiving element 44*b* are moved to be arranged at the second positions (152*a*, 152*b*), respectively; and then all the nozzles may be inspected in a state that the light emitting element 44*a* and the light receiving element 44*b* are arranged at the second positions (152*a*, 152*b*), respectively.

11Eleventh Modification

Each of the above-described embodiment and modifications thereof is an example in which the present invention is applied to an ink-jet printer which jets an ink onto recording paper. It is possible, however, to apply the present invention to a liquid-droplet jetting apparatus used for a purpose other than jetting the ink. The present invention is applicable to a various kinds of liquid-droplet jetting apparatus such as an apparatus which jets a conductive paste onto a substrate to form a wiring pattern on the substrate; an apparatus which jets an organic light-emitting substance onto a substrate to form an organic EL display; an apparatus which jets an optical resin onto a substrate to form an optical device such as light guide; and the like.

What is claimed is:

1. A liquid-droplet jetting apparatus for jetting liquid droplet, comprising:

a liquid-droplet jetting head having a liquid droplet jetting surface in which a plurality of nozzles are arranged in a predetermined direction, the plurality of nozzles forming groups of the nozzles;

a movable body which moves in the predetermined direction relative to the liquid-droplet jetting head, the movable body having a detector which detects jetting states of the nozzles, and a purge cap which is provided on the movable body and which is movable in the predetermined direction integrally with the movable body;

a cap driving mechanism which is provided on the moveable body and which moves the purge cap between a purge position at which the purge cap covers a part of the liquid droplet jetting surface and a purge standby position which is apart from the liquid droplet jetting surface; and a controller which controls the movable body and the cap driving mechanism;

wherein the controller controls the moveable body and the cap driving mechanism such that the purge cap is at the purge standby position when a jetting state of a nozzle of the nozzles is detected by the detector; further when the purge cap driven by the cap driving mechanism moves from the purge standby position to the purge position, the movable body is at a position at which the purge cap covers a jetting port of the nozzle being detected; and wherein jetting state detection is performed for each of the groups of the nozzles which is covered by the purge cap at a time, and when at least one of the nozzles belonging to one of the groups is detected to be in an abnormal jetting state, the nozzles belonging to the group are purged simultaneously; and the detector has a light-emitting element which emits light in a direction crossing the predetermined direction and a light-receiving element which receives the light from the light-emitting element; and the light emitted from the light-emitting element to the light-receiving element is blocked by liquid droplets jetted from the nozzles.

2. The liquid-droplet jetting apparatus according to claim 1, wherein the purge cap covers an area including a jetting port of a nozzle, among the nozzles, detected to be abnormal by the detector.

3. The liquid-droplet jetting apparatus according to claim 1, further comprising a discharge forcing unit which forcibly discharges a liquid from the jetting ports of the nozzles covered by the purge cap.

4. The liquid-droplet jetting apparatus according to claim 1, wherein the movable body is provided with a wiper which wipes a liquid adhering to the liquid-droplet jetting head.

5. The liquid-droplet jetting apparatus according to claim 1, wherein when the jetting state is detected by the detector, the purge cap is at a position under the nozzle which is being detected by the detector.

6. The liquid-droplet jetting apparatus according to claim 1, wherein the detector has a second light-emitting element and a second light-receiving element, and the second light-emitting element and the second light-receiving element are arranged such that light emitted from the second light-emitting element to the second light-receiving element is inclined with respect to the predetermined direction and is intersected with the light emitted from the light-emitting element to the light-receiving element at positions under jetting ports of the nozzles.

7. The liquid-droplet jetting apparatus according to claim 1, wherein the detector further includes a first arm and a second arm which are connected to each other by a supporting section extending between the first arm and the second arm, the first arm and the second arm are pivotally attached to the movable body respectively with a central portion in the longitudinal direction of the supporting section as a pivot center, and the light-emitting element is attached to the first arm and the light-receiving element is attached to the second arm.

8. A liquid-droplet jetting apparatus for jetting liquid droplet, comprising:

a first liquid-droplet jetting head having a liquid droplet jetting surface in which a plurality of first nozzles are arranged in a predetermined direction, the plurality of first nozzles forming groups of the first nozzles;

a movable body movable in the predetermined direction relative to the first liquid-droplet jetting head;

a driving mechanism which drives the movable body in the predetermined direction;

a position detector which detects a position of the movable body with respect to the predetermined direction;

a jetting state detector which is provided on the movable body to move in the predetermined direction together with the movable body and which detects a jetting state for each of the first nozzles;

a purge cap which is provided on the movable body and which is movable in the predetermined direction integrally with the movable body;

a cap driving mechanism which is provided on the movable body and which is configured to move the purge cap between a purge position at which the purge cap covers a part of the liquid droplet jetting surface and a purge standby position which is apart from the liquid droplet jetting surface; and a controller which controls the driving mechanism and the cap driving mechanism;

wherein the controller controls the driving mechanism and the cap driving mechanism such that the purge cap is at the purge standby position when a jetting state of a first nozzle of the first nozzles is detected by the jetting state detector; further when the purge cap driven by the cap driving mechanism moves from the purge standby position to the purge position, the movable body is at a position at which the purge cap covers a jetting port of the first nozzle being detected; and wherein jetting state detection is performed for each of the groups of the first nozzles which is covered by the purge cap at a time, and when at least one of the first nozzles belonging to one of the groups is detected to be in an abnormal jetting state, the first nozzles belonging to the group are purged simultaneously;

the jetting state detector has a light-emitting element which emits light in a direction crossing the predetermined direction and a light-receiving element which receives the light from the light-emitting element; and the light emitted from the light-emitting element to the light-receiving element is blocked by liquid droplets jetted from the first nozzles.

9. The liquid-droplet jetting apparatus according to claim 8, wherein: the liquid-droplet jetting apparatus further includes a discharge forcing unit which forcibly discharges a liquid from a jetting port of a first nozzle among the first nozzles which is located at the part covered by the purge cap; and the purge cap covers only a part of the liquid droplet jetting surface.

10. The liquid-droplet jetting apparatus according to claim 9, wherein when the jetting state detector detects that a jetting state of a first nozzle among the first nozzles is abnormal, the purge cap covers an area, on the liquid droplet jetting surface, which includes a jetting port of the first nozzle detected to be abnormal.

11. The liquid-droplet jetting apparatus according to claim 9, wherein a relationship of W=nP (n is natural number) is established in which W is a width of the purge cap in the predetermined direction and P is a pitch at which the first nozzles are arranged with respect to the predetermined direction.

12. The liquid-droplet jetting apparatus according to claim 9, wherein after the liquid is discharged by the discharge forcing unit forcibly from the first nozzle covered by the purge cap, the jetting state detector detects a jetting state of the first nozzle again.

13. The liquid-droplet jetting apparatus according to claim 9, wherein the movable body is provided with a wiper which wipes the liquid adhering to the liquid droplet jetting surface.

14. The liquid-droplet jetting apparatus according to claim 8, further comprising: a second liquid-droplet jetting head which has a second nozzle and which is movable in the predetermined direction; a head drive mechanism which drives the second liquid-droplet jetting head in the predetermined direction; and a head position detector which detects a position of the second liquid-droplet jetting head with respect to the predetermined direction; wherein when the jetting state detector detects that a jetting state of a first nozzle among the first nozzles is abnormal, the second liquid-droplet jetting head is moved to a position corresponding to a position of the first nozzle, and a liquid droplet is jetted from the second nozzle instead of the first nozzle.

15. The liquid-droplet jetting apparatus according to claim 8, wherein when the jetting state is detected by the jetting state detector, the purge cap is at a position under the first nozzle which is being detected by the jetting state detector.

16. The liquid-droplet jetting apparatus according to claim 8, wherein the jetting state detector has a second light-emitting element and a second light-receiving element, and the second light-emitting element and the second light-receiving element are arranged such that light emitted from the second light-emitting element to the second light-receiving element is inclined with respect to the predetermined direction and is intersected with the light emitted from the light-emitting element to the light-receiving element at positions under jetting ports of the first nozzles.

17. The liquid-droplet jetting apparatus according to claim 8, wherein the jetting state detector further includes a first arm and a second arm which are connected to each other by a supporting section extending between the first arm and the second arm, the first arm and the second arm are pivotally attached to the movable body respectively with a central portion in the longitudinal direction of the supporting section as a pivot center, and the light-emitting element is attached to the first arm and the light-receiving element is attached to the second arm.

18. A method of recovering a liquid-droplet jetting head for jetting liquid droplet and having a liquid droplet jetting surface in which a plurality of nozzles are arranged in a predetermined direction, the plurality of nozzles forming groups of the nozzles, the method comprising:

moving a detector along the liquid-droplet jetting head;

detecting abnormality of the nozzles by the detector;

moving a purge cap in the predetermined direction with a cap driving mechanism which moves the purge cap between a purge position at which the purge cap covers a part of the liquid droplet jetting surface and a purge standby position which is apart from the liquid droplet jetting surface; and covering and purging a nozzle, among the nozzles, detected to be abnormal, with the purge cap;

wherein the purge cap is at the purge standby position when a jetting state of a nozzle of the nozzles is detected by the detector; and further when the purge cap driven by the cap driving mechanism moves from the purge standby position to the purge position, a movable body provided with the detector and the purge cap is at a position at which the purge cap covers a jetting port of the nozzle being detected; and abnormality detection of the nozzles is performed for each of the groups of the nozzles which is covered by the purge cap at a time, and when at least one of the nozzles belonging to one of the groups is detected to be abnormal, the nozzles belonging to the group are purged simultaneously; and the detector has a light-emitting element which emits light in a direction crossing the predetermined direction and a light-receiving element which receives the light from the light-emitting element; and the light emitted from the light-emitting element to the light-receiving element is blocked by liquid droplets jetted from the nozzles.

19. The method of recovering the liquid-droplet jetting head according to claim 18, further comprising, after the nozzle detected to be abnormal is purged, detecting again a jetting state of the purged nozzle.

20. The method of recovering a liquid-droplet jetting head according to claim 18, wherein abnormality detection is performed by the detector, the purge cap is at a position under the nozzle which is being detected by the detector.

21. The method of recovering a liquid-droplet jetting head according to claim 18, wherein the detector has a second light-emitting element and a second light-receiving element, and the second light-emitting element and the second light-receiving element are arranged such that light emitted from the second light-emitting element to the second light-receiving element is inclined with respect to the predetermined direction and is intersected with the light emitted from the light-emitting element to the light-receiving element at positions under jetting ports of the nozzles.

22. The method of recovering a liquid-droplet jetting head according to claim 18, wherein the detector further includes a first arm and a second arm which are connected to each other by a supporting section extending between the first arm and the second arm, the first arm and the second arm are pivotally attached to the movable body respectively with a central portion in the longitudinal direction of the supporting section as a pivot center, and the light-emitting element is attached to the first arm and the light-receiving element is attached to the second arm.

* * * * *